US007792178B2

(12) United States Patent
Tenzek et al.

(10) Patent No.: US 7,792,178 B2
(45) Date of Patent: Sep. 7, 2010

(54) INDUCTION FURNACE FOR MELTING GRANULAR MATERIALS

(75) Inventors: Anthony M. Tenzek, Hanoverton, OH (US); David A. Lazor, Hubbard, OH (US)

(73) Assignee: Ajax Tocco Magnethermic Corporation, Euclid, OH (US)

( * ) Notice: Subject to any disclaimer, the term of this patent is extended or adjusted under 35 U.S.C. 154(b) by 790 days.

(21) Appl. No.: 11/516,837

(22) Filed: Sep. 7, 2006

(65) Prior Publication Data

US 2007/0002928 A1 Jan. 4, 2007

Related U.S. Application Data

(62) Division of application No. 10/851,565, filed on May 21, 2004, now Pat. No. 7,113,535.

(51) Int. Cl.
*H05B 6/22* (2006.01)

(52) U.S. Cl. ..... 373/151; 373/156; 373/157

(58) Field of Classification Search ..... 373/5, 373/6, 7, 138, 142, 144, 146, 151, 152, 155, 373/156, 157, 59, 147, 149, 140, 116, 84
See application file for complete search history.

(56) References Cited

U.S. PATENT DOCUMENTS

| | | | | |
|---|---|---|---|---|
| 1,655,983 | A | 1/1928 | Brace | |
| 1,782,359 | A | 11/1930 | Linnhoff | |
| 2,122,241 | A * | 6/1938 | Arnold | 373/144 |
| 2,773,750 | A * | 12/1956 | Conant | 422/199 |
| 3,538,981 | A | 11/1970 | Phipps | |
| 3,696,223 | A | 10/1972 | Metcalf et al. | |
| 4,178,986 | A * | 12/1979 | Smashey | 164/513 |
| 4,594,723 | A | 6/1986 | Folgero et al. | |
| 4,606,037 | A | 8/1986 | Terashima et al. | |
| 4,915,723 | A | 4/1990 | Kaneko et al. | |
| 5,315,085 | A | 5/1994 | Ferguson | |
| 5,367,532 | A * | 11/1994 | Boen et al. | 373/156 |
| 5,502,743 | A | 3/1996 | Conochie et al. | |
| 5,690,734 | A | 11/1997 | Imaeda et al. | |
| 5,781,581 | A | 7/1998 | Fishman et al. | |
| 6,361,597 | B1 | 3/2002 | Takase et al. | |

(Continued)

FOREIGN PATENT DOCUMENTS

| | | | |
|---|---|---|---|
| JP | 52061844 | A | 5/1977 |

*Primary Examiner*—Tu B Hoang
*Assistant Examiner*—Hung Nguyen
(74) *Attorney, Agent, or Firm*—Sand & Sebolt

(57) ABSTRACT

A continuous- or intermittent-melt induction furnace useful for heating and/or melting semi-conductor or other materials includes an induction coil, a susceptor switchable between open and closed electric circuit modes, and a crucible. The susceptor is inductively or resistively heated in the closed circuit mode and transfers heat to material in the melting cavity to make it susceptible to inductive heating. The susceptor is then switched to the open circuit mode and the susceptible material is directly inductively heated to melt remaining solid material. A cone-shaped flow guide in the melting cavity improves molten material flow to improve the ability to draw small-particle material into the melt and increase crucible life due to improved heat uniformity. A trap passage communicating with the melting cavity and an exit opening in the crucible allows the flow of material through the exit opening to be controlled by pressure differentials on either side of the trap passage.

26 Claims, 22 Drawing Sheets

U.S. PATENT DOCUMENTS 6,393,044 B1 * 5/2002 Fishman et al. ..... 373/138
6,409,791 B1 * 6/2002 Petit et al. ..... 373/144
6,898,232 B2 * 5/2005 Miller et al. ..... 373/140
2005/0111518 A1 * 5/2005 Roach et al. ..... 373/146

* cited by examiner

INDUCTION FURNACE FOR MELTING GRANULAR MATERIALS

CROSS REFERENCE TO RELATED APPLICATION

This application is a divisional of U.S. patent application Ser. No. 10/851,565, filed May 21, 2004; the disclosure of which is incorporated herein by reference.

BACKGROUND OF THE INVENTION

1. Technical Field

The invention relates to induction heating and an improved induction furnace. More particularly, the invention relates to an induction furnace for melting materials not susceptible to inductive heating at lower temperatures but which are susceptible to inductive heating at higher temperatures, especially upon melting. Specifically, the invention relates to an induction furnace capable of continuously or intermittently melting such materials.

2. Background Information

Induction furnaces are well known in the art. However, there are a variety of difficulties related to the inductive heating and melting of materials that are initially non-conductive or which have particle sizes sufficiently small so that they are not susceptible to inductive heating. Many prior art induction furnaces utilize a conductive crucible such that an induction coil couples with the crucible to transfer energy directly to the crucible to heat the crucible whereby heat is then transferred from the crucible to the material to be melted via thermal conduction. In certain cases, the induction frequency and the thickness of the crucible wall may be selected so that a portion of the electromagnetic field from the coil allows coupling with electrically conductive material inside the crucible to inductively heat the material directly. However, the direct inductive heating in such cases is quite limited. Because direct inductive heating of the material to be melted is far more effective than the method described above, a system to effect such direct inductive heating is highly desirable.

In addition, the conductive crucibles of the prior art may react with the material to be melted which causes unwanted impurities in the melt and thus requires the use of a non-reactive liner inside the crucible to prevent formation of such impurities. Typically, however, such liners are electrically non-conductive and thermally insulating. As a result, the transfer of heat from the crucible to the materials to be melted is greatly impeded and thus melting times are substantially increased. To expedite the transfer of heat from the crucible to the material to be melted, the crucible must be heated to undesirably high temperatures which can decrease the life of the crucible and liner.

In addition, there remains a need for an induction furnace capable of producing a continuous melt in an efficient manner, especially for semi-conductor materials. An efficient continuous melt induction furnace is particularly useful related to continuous formation of semi-conductor crystals, which are highly valued in the production of computer chips.

U.S. Pat. No. 6,361,597 to Takase et al. teaches three embodiments of an induction furnace especially intended for melting semi-conductor materials and adapted to supply the molten material to a main crucible for pulling of semi-conductor crystals therefrom. Unlike the prior art discussed above, Takase et al. uses a quartz crucible which is electrically non-conductive along with a susceptor which is in the form of a carbon or graphite cylinder. In each of the three embodiments of Takase et al., the carbon or graphite cylinder susceptor is initially inductively heated by a high frequency coil whereby heat is transferred from the susceptor to raw material inside the crucible in order to begin the melting process. Once the raw material is melted, it is directly inductively heated by the high frequency coil in order to speed up the melting process. While this is a substantial improvement over the previously discussed prior art, the induction furnace of Takase et al. still leaves room for improvement.

The first two embodiments of Takase et al. involve the use of a carbon cylinder susceptor which encircles the quartz crucible and is movable in a vertical direction. This provides a mechanism whereby the susceptor may be inductively heated and then either moved out of the electromagnetic field of the induction coil altogether or moved to a position which is more advantageous for heating selected portions of the material within the crucible. One drawback of this configuration is the need for a mechanism to move the susceptor in a vertical direction. The third embodiment of Takase et al. provides a susceptor having a crucible-like configuration with a cylindrical side wall of the susceptor covering the side wall of the quartz crucible and a bottom of the susceptor covering the bottom wall of the quartz crucible. The susceptor is not vertically moveable in the third embodiment. Instead, the thickness of the susceptor sidewall and the frequency applied by the coil are selected so that the penetration depth of the induction current will extend beyond the susceptor into the quartz crucible so that it can inductively heat material inside.

The third embodiment of Takase et al. primarily suffers from the fact that the cylindrical susceptor remains in place and thus prevents inductive heating from more effectively being focused on the raw material within the crucible. Instead, the coil continues to inductively heat the carbon cylinder so that energy which might be applied to the material is absorbed by the carbon cylinder, which transfers heat to the raw material in the crucible in a far less effective manner.

BRIEF SUMMARY OF THE INVENTION

The present invention provides an apparatus for heating a material, the apparatus comprising an electromagnetic induction member; an electrically conductive member selectively switchable between a closed electrical circuit and an open electrical circuit whereby the conductive member is inductively heatable by the induction member via the closed electrical circuit and whereby when the conductive member forms the open electrical circuit, inductive heating of the conductive member by the induction member which would occur if the conductive member formed the closed electrical circuit is eliminated; and the conductive member being adapted to transfer heat to the material.

The present invention also provides a method of heating material comprising the steps of: heating an electrically conductive member inductively with an electromagnetic induction member when the conductive member is in a closed electrical circuit mode; transferring heat from the conductive member to the material; and switching the conductive member to an open circuit mode to prevent further inductive heating of the conductive member which would occur if the conductive member remained in the closed circuit mode.

The present invention further provides an apparatus for heating a material, the apparatus comprising an electrically conductive member selectively switchable between a closed electrical circuit mode and an open electrical circuit mode; the conductive member being resistively heatable when in the closed circuit mode and not being resistively heatable when in the open circuit mode; the conductive member being adapted to transfer heat to the material; and an electromagnetic induction member adapted to inductively heat the material.

The present invention also provides a method of heating material comprising the steps of heating an electrically conductive member resistively when the conductive member is in a closed electrical circuit mode; transferring heat from the conductive member to the material; heating the material inductively with an electromagnetic induction member; and switching the conductive member to an open circuit mode to prevent inductive heating of the conductive member which would occur if the conductive member remained in the closed circuit mode.

The present invention further provides an apparatus comprising a crucible defining a melting cavity; an electromagnetic induction member for inductively heating molten material within the melting cavity; and a flow guide disposed within the melting cavity for directing the inductively heated molten material to flow upwardly within the cavity.

The present invention also provides an apparatus comprising a crucible defining a melting cavity and an exit opening; and a trap defining a through passage having an entrance end defining an opening in communication with the melting cavity and an exit end defining an opening in communication with the exit opening of the crucible for transporting molten material from the melting cavity to the exit opening of the crucible whereby the relative pressure exerted on molten material in the passage controls the flow of molten material through the exit opening.

BRIEF DESCRIPTION OF THE SEVERAL VIEWS OF THE DRAWINGS

Preferred embodiments of the invention, illustrative of the best modes in which applicant contemplates applying the principles, are set forth in the following description and are shown in the drawings and are particularly and distinctly pointed out and set forth in the appended claims.

Similar numbers refer to similar parts throughout the specification.

DETAILED DESCRIPTION OF THE INVENTION

Figure 8:
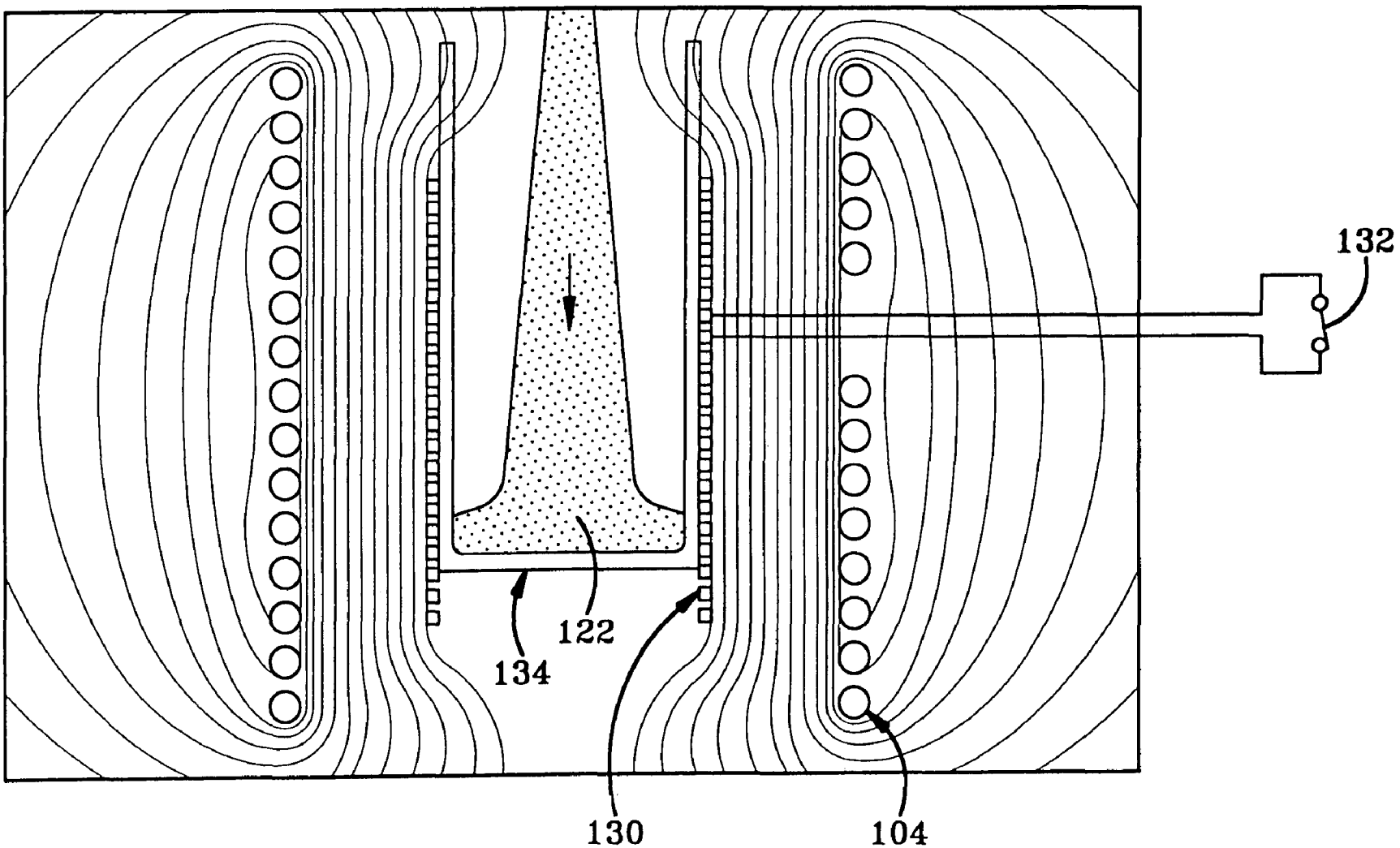
FIG. 8 is a diagrammatic view showing the electromagnetic field acting on the melting coil.
Figure 9:
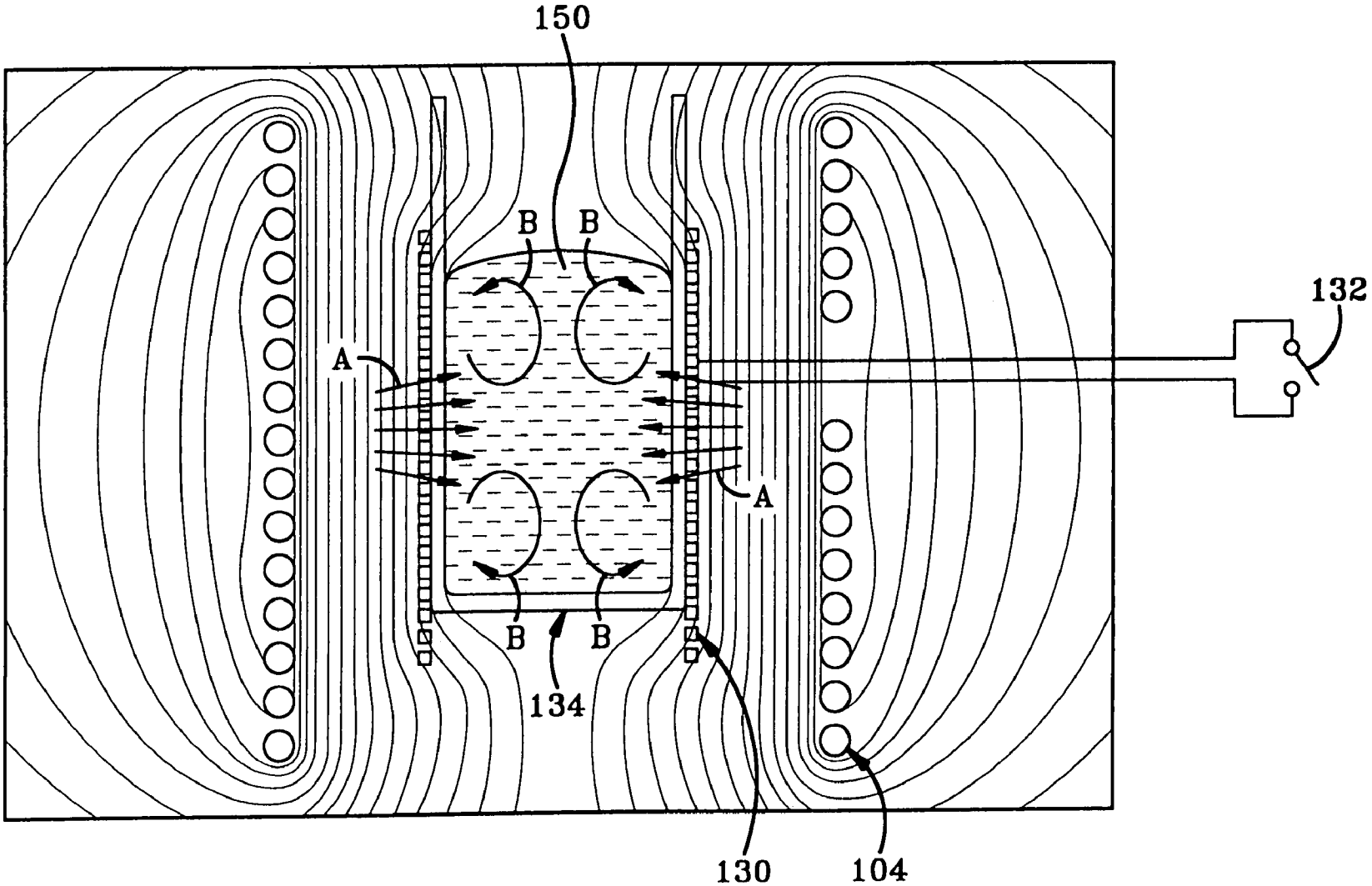
FIG. 9 is similar to FIG. 8 showing the electromagnetic field acting on the molten material within the crucible, and showing electromotive forces acting on the molten material and currents within the molten material.
Figure 16:
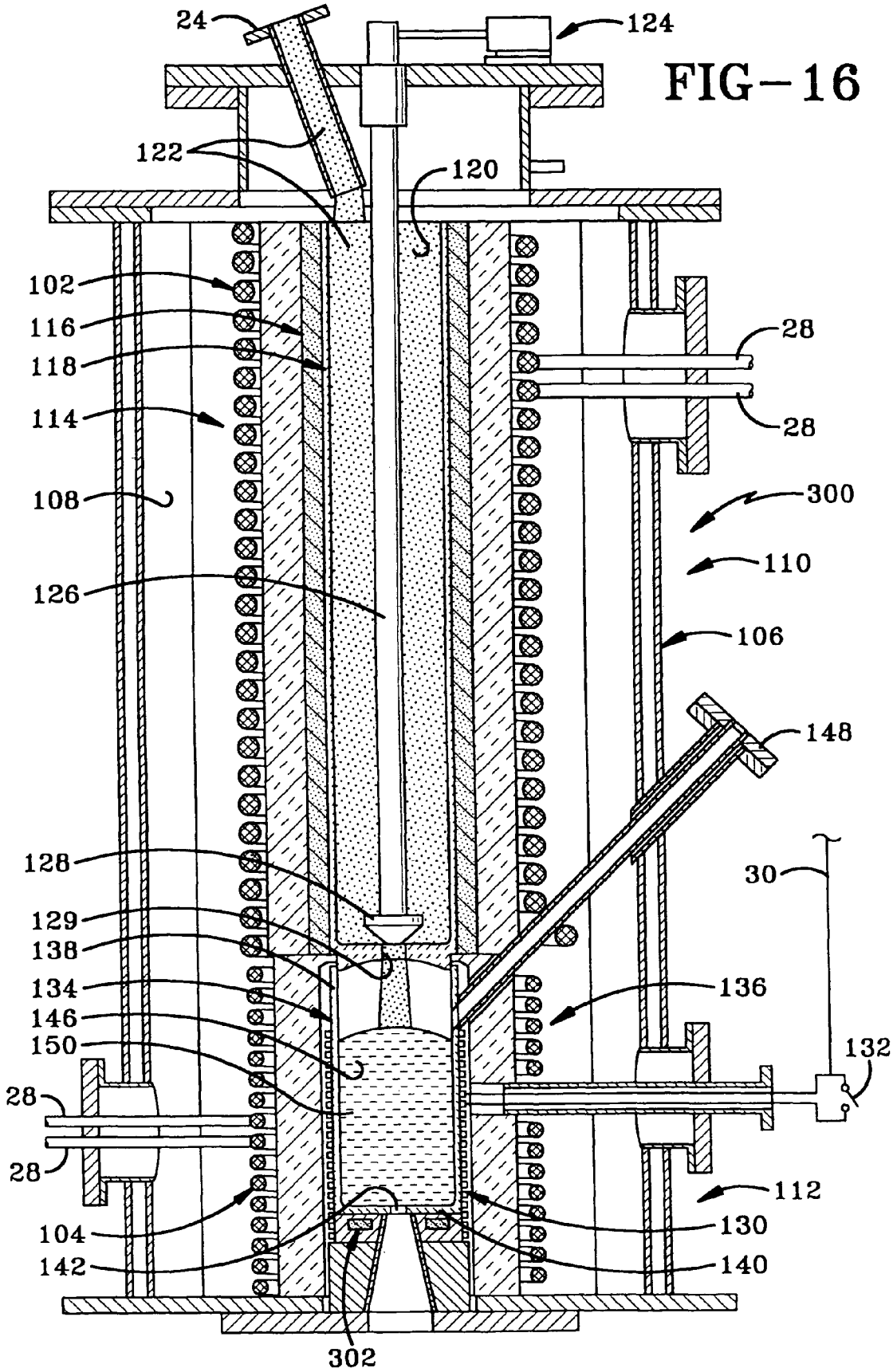
FIG. 16 is similar to FIG. 2 showing a third embodiment of the present invention which includes a susceptor disk beneath the crucible.
Figure 17:
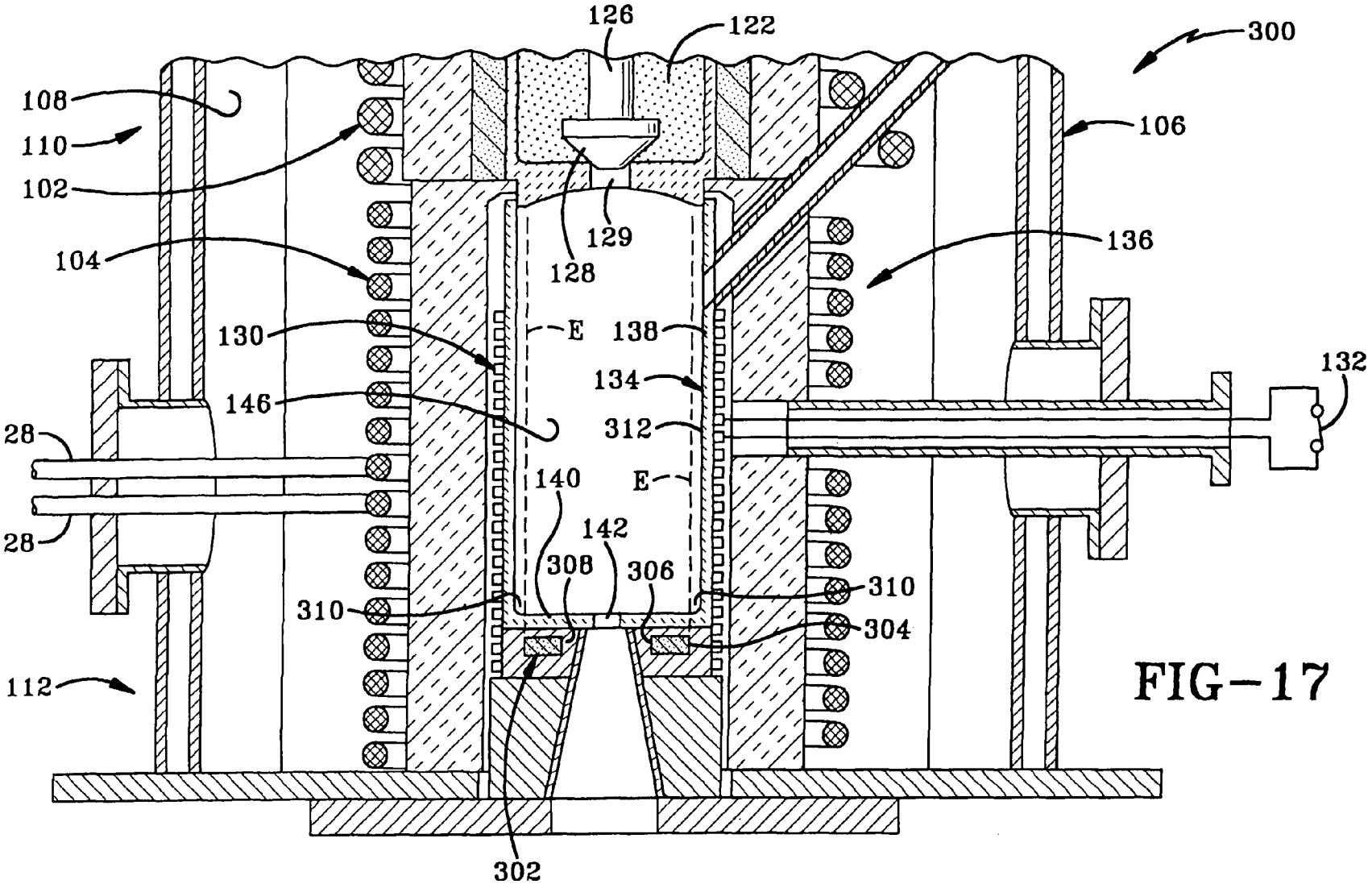
FIG. 17 is an enlarged fragmentary sectional view of the furnace shown in FIG. 16 wherein the crucible is empty.
Figure 22:
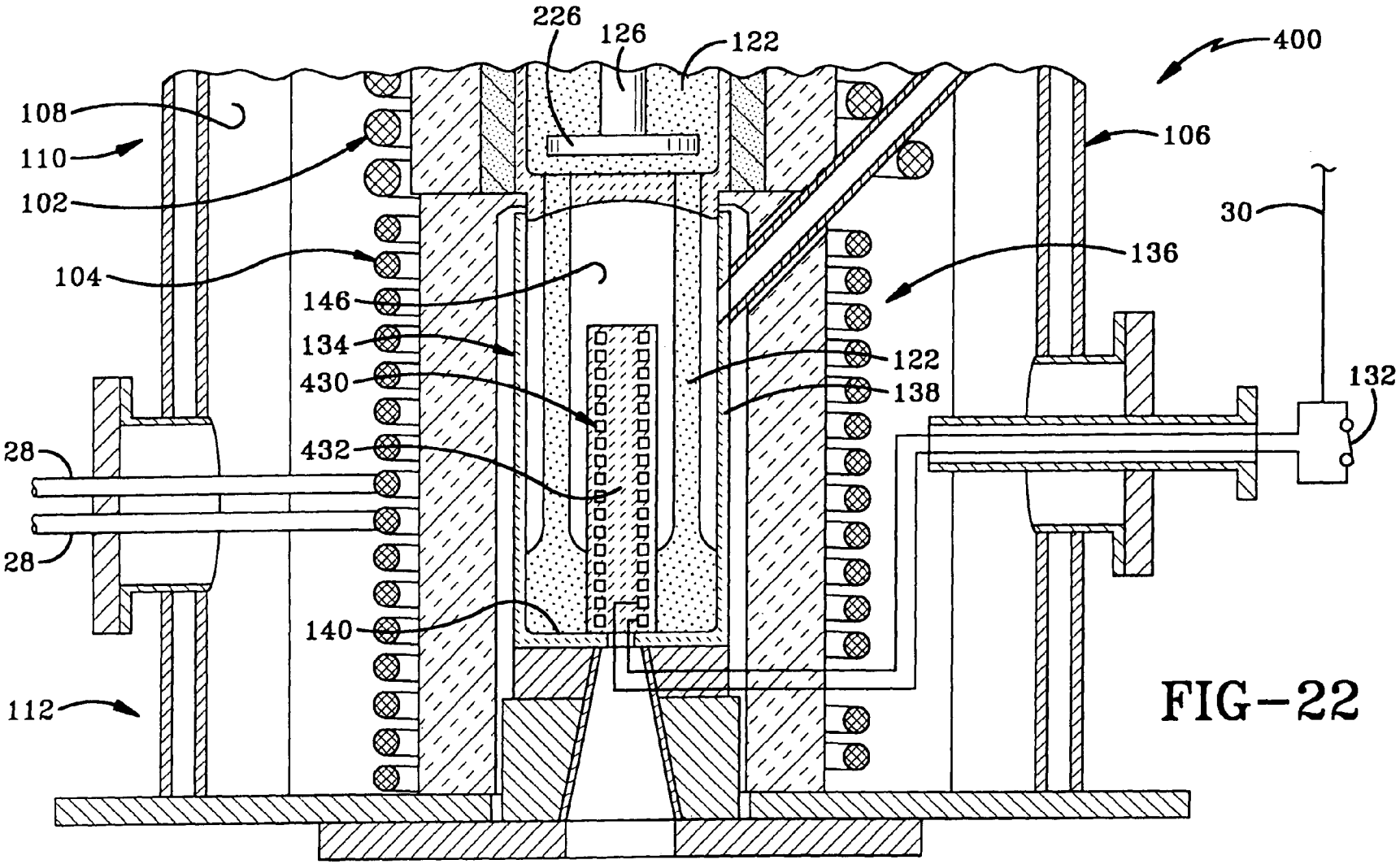
FIG. 22 is similar to FIG. 4 showing a fourth embodiment of the induction furnace of the present invention with the melting coil/susceptor disposed within the melting cavity and a feed mechanism like that in FIG. 12.

The improved induction furnace of the present invention is shown in four embodiments in the figures although other embodiments are contemplated as is apparent to one of skill in the art. Specifically, the first embodiment of the induction furnace is indicated generally at 100, and is shown in FIGS. 1-3, the second embodiment is indicated generally at 200, and is shown in FIGS. 8-9, the third embodiment is indicated generally at 300, and is shown in FIGS. 16-17 and the fourth embodiment is indicated generally at 400, and is shown in FIG. 22.

Figure 1:
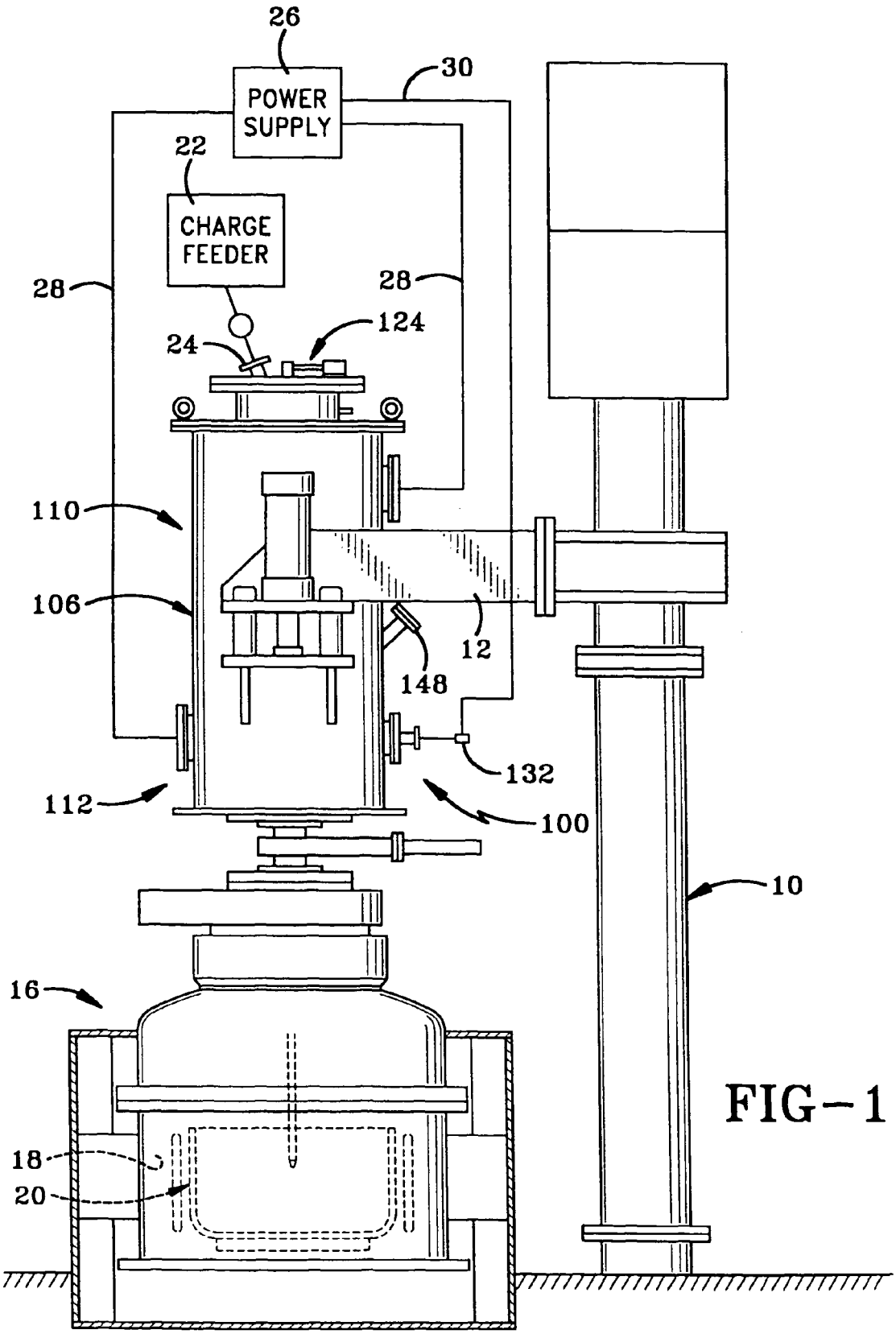
FIG. 1 is a side elevational view of a first embodiment of the induction furnace of the present invention in use with a preheating assembly and crystal formation apparatus.

With reference to FIG. 1, furnace 100 is mounted on a support stand 10 via a support arm 12 extending therefrom, although furnace 100 may be supported by any suitable means. Furnace 100 is disposed above and connected to a standard crystal formation apparatus 16 which contains an interior chamber 18 in which is disposed a receiving crucible or tundish 20. A charge feeder 22 situated above furnace 100 is in communication with a feed port 24 whereby raw material may be fed into furnace 100. As shown in FIGS. 1-2, a power supply 26 is in electrical communication via wires 28 with a preheating induction coil 102 and a melting induction coil 104. Power supply 26 may also be in electrical communication via wires 30 with a melting coil 130.

Figure 2:
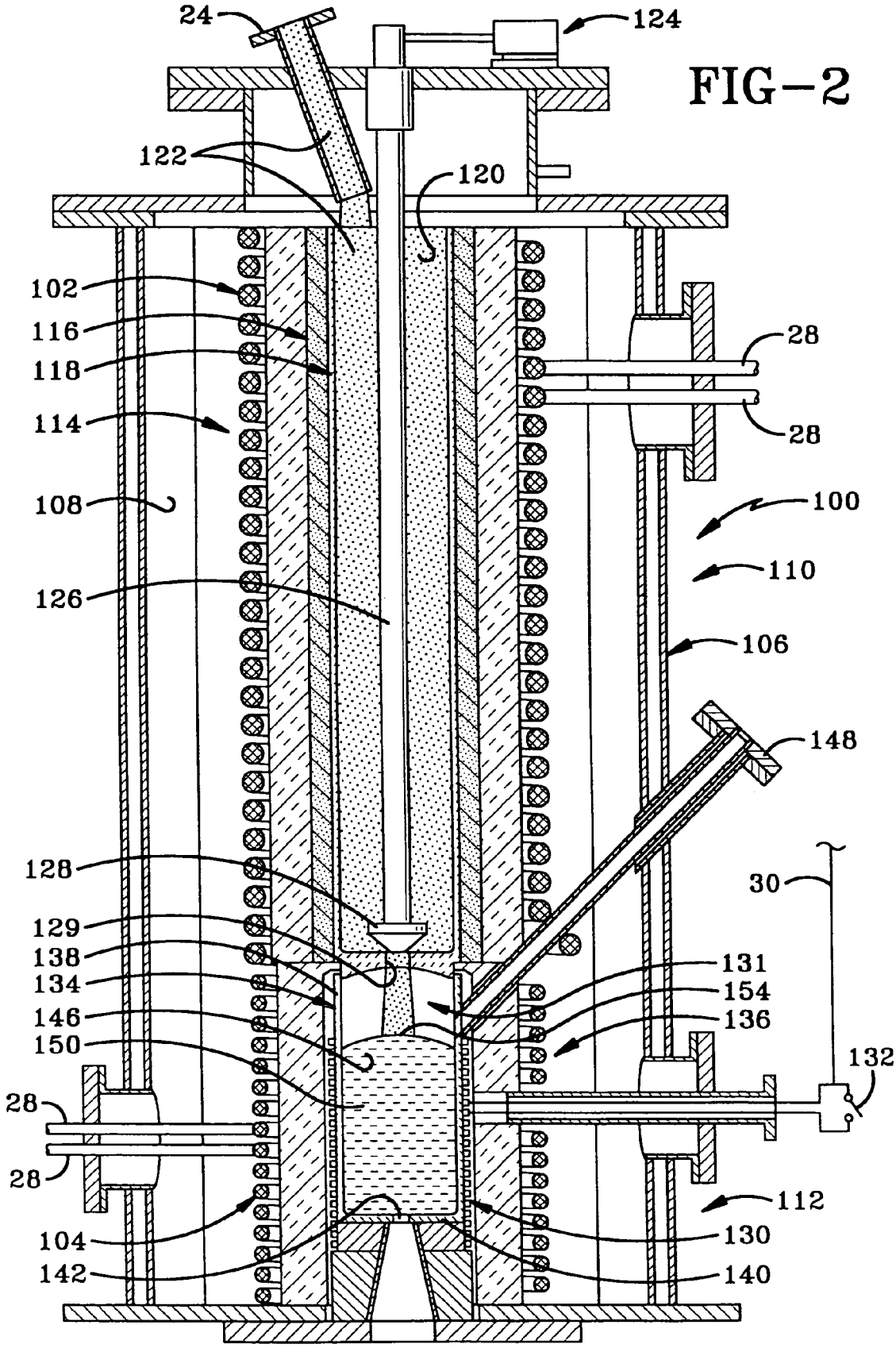
FIG. 2 is an enlarged sectional view of the furnace of FIG. 1 showing the first embodiment in use with the preheating assembly.

With reference to FIG. 2, a double-walled heating container 106 defines an interior chamber 108 which is divided into a preheat zone 110 and a melting zone 112 there below. A preheating assembly 114 is disposed within preheat zone 110 and includes a cylindrical susceptor 116 disposed within preheating induction coil 102 and a preheat tube 118 disposed within susceptor 116 and closely adjacent or in abutment with susceptor 116. Preheat tube 118 defines an interior chamber 120 for receiving raw material 122 from feed port 24 for preheating the raw material. A feed mechanism 124 includes a control arm 126 with a valve 128 at the terminal end thereof. Valve 128 is selectively seated in exit opening 129 formed in the lower end of preheat tube 118. Furnace 100 further defines a quiescent zone 131 below preheat assembly 114, as detailed further below.

Figure 3:
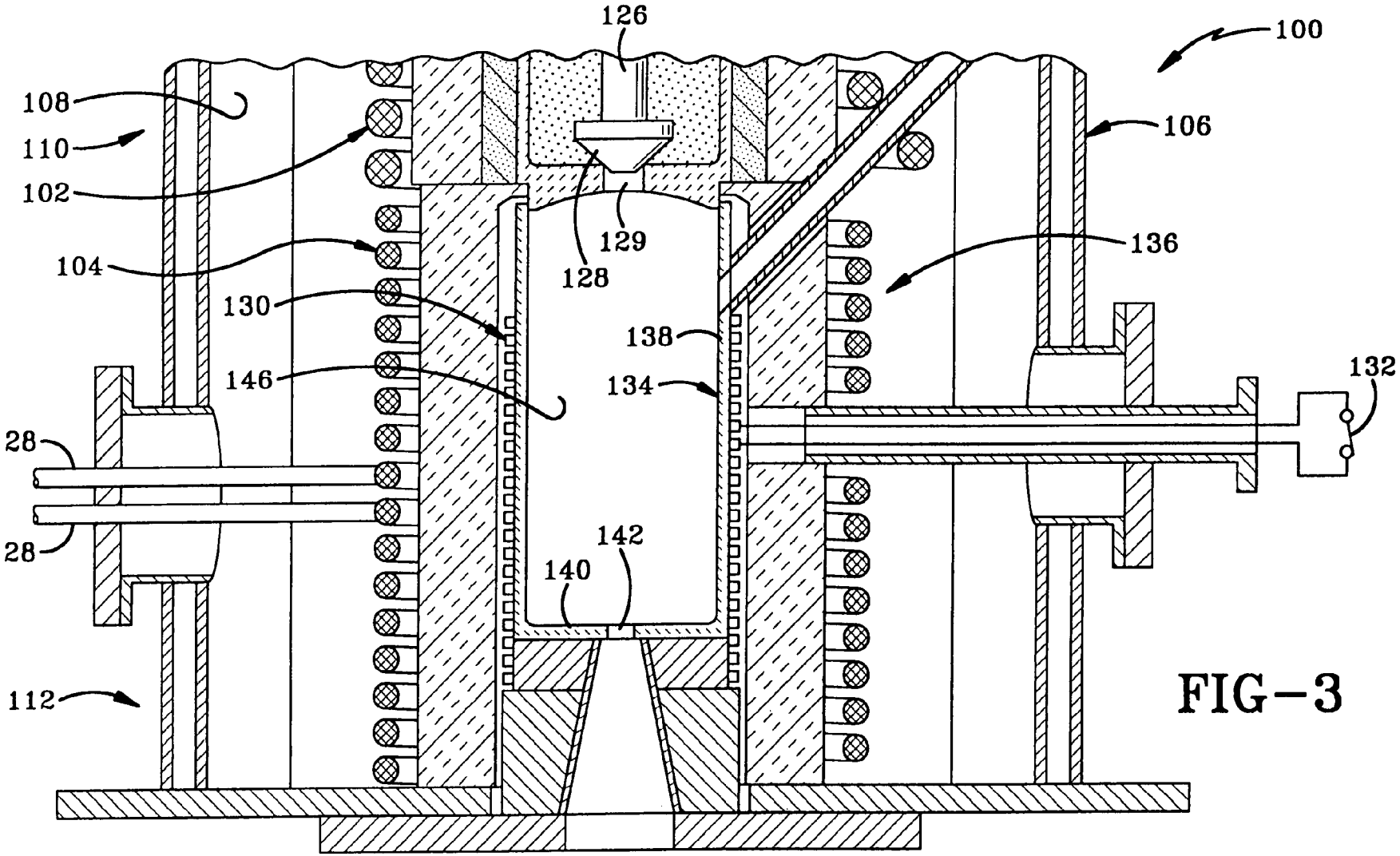
FIG. 3 is an enlarged fragmentary sectional view of the furnace shown in FIG. 2 showing the crucible empty.

In accordance with one of the main features of the present invention and with reference to FIGS. 2-3, substantially cylindrical melting coil 130, which acts as a susceptor, is disposed within melting induction coil 104 and is switchable between a closed electrical circuit mode and an open electrical circuit mode via switch 132. A melting crucible 134 is disposed within melting coil 130 and in combination with melting induction coil 104 and melting coil 130, forms a melting assembly 136. Melting coil 130 may provide lateral support for crucible 134.

Melting crucible 134 includes a substantially cylindrical side wall 138 extending upwardly from a substantially flat bottom wall 140 which defines an exit opening 142 through which the flow of molten material is controlled by any suitable mechanism known in the art. Melting crucible 134 defines a melting cavity 146 in communication with exit opening 142 of bottom wall 140 as well as exit opening 129 of tube 118. In addition, a laser sight port 148 is in visual communication with melting cavity 146.

Figure 4:
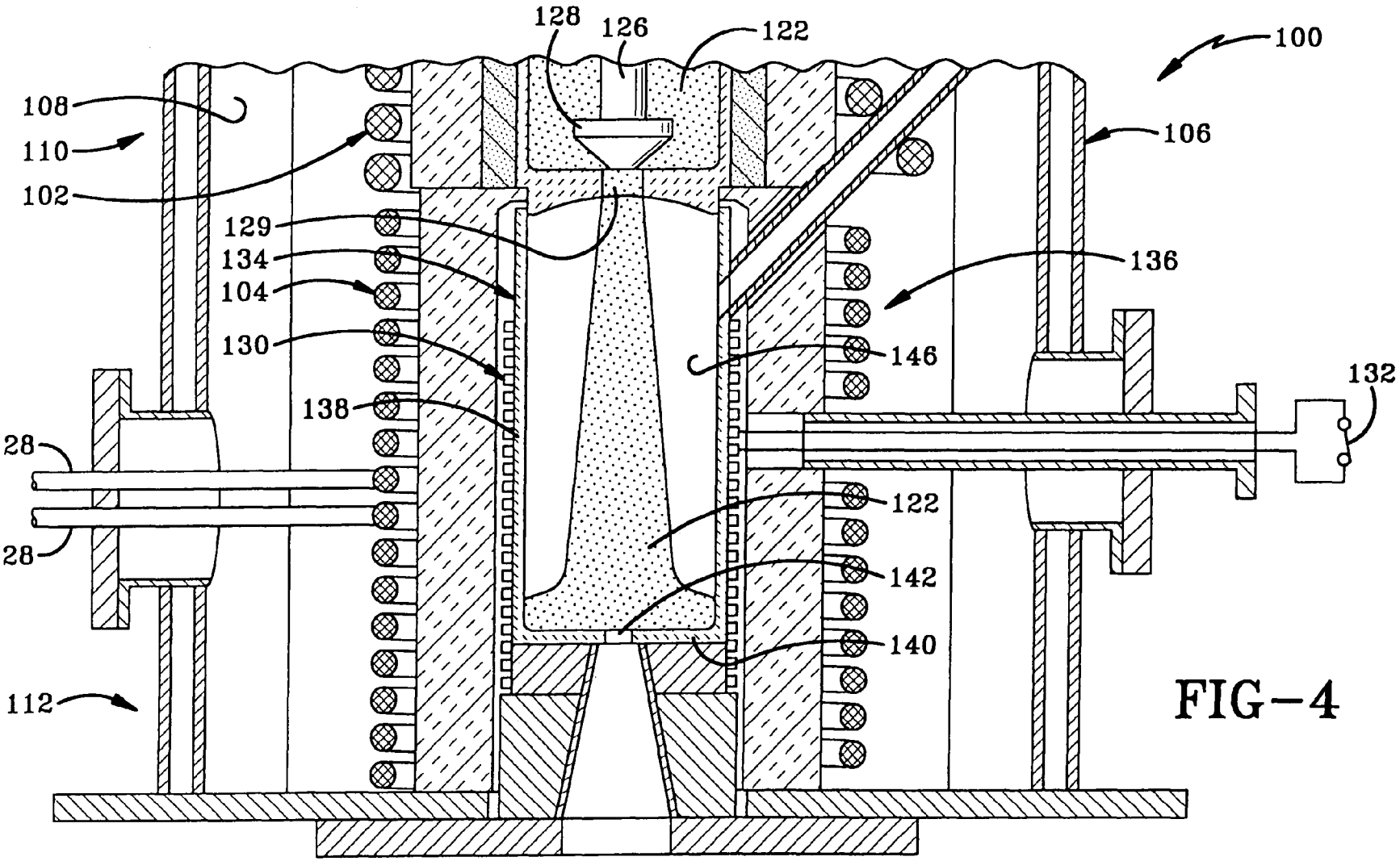
FIG. 4 is similar to FIG. 3 but showing an initial charge of raw material in the crucible.

In operation, and with reference to FIGS. 1-7, furnace 100 functions as follows. Referring to FIGS. 1-3, raw material 122 is fed via charge feeder 22 into feed port 24 and subsequently into interior chamber 120 of preheating tube 118. Valve 128 (an angle of repose valve) is initially in a closed position (FIG. 3) to prevent raw material 122 from passing through exit hole 129. Power supply 26 is then operated to provide electrical power through wires 28 to preheating induction coil 102. Induction coil 102 thus produces an electromagnetic field so that coil 102 couples with susceptor 116 to inductively heat susceptor 116. In turn, susceptor 116 transfers heat to raw material 122 through preheating tube 118 via conduction and radiation. Raw material 122 is thus heated to a point below the melting temperature of the material prior to charging crucible 134. Raw material 122 is typically granular, powdered or of another particulate form. Once material 122 is sufficiently heated, feed mechanism 124 is operated to open valve 128 whereby a portion of material 122 is released into melting cavity 146 of crucible 134, as shown in FIG. 4. Feed mechanism 124 is configured to control the rate at which material 122 falls into melting cavity 146.

Figure 5:
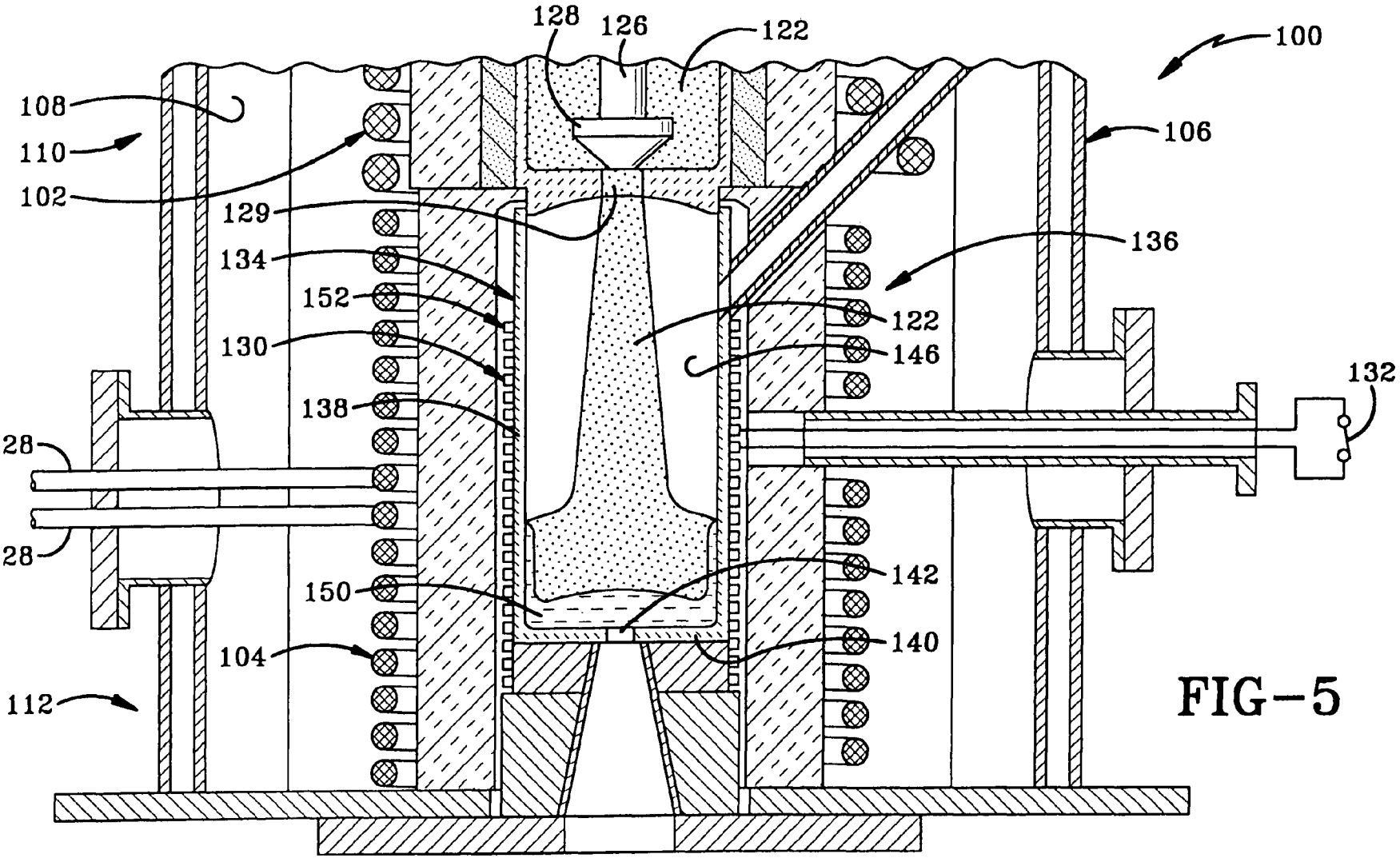
FIG. 5 is similar to FIG. 4 containing an initial molten portion of the raw material.
Figure 6:
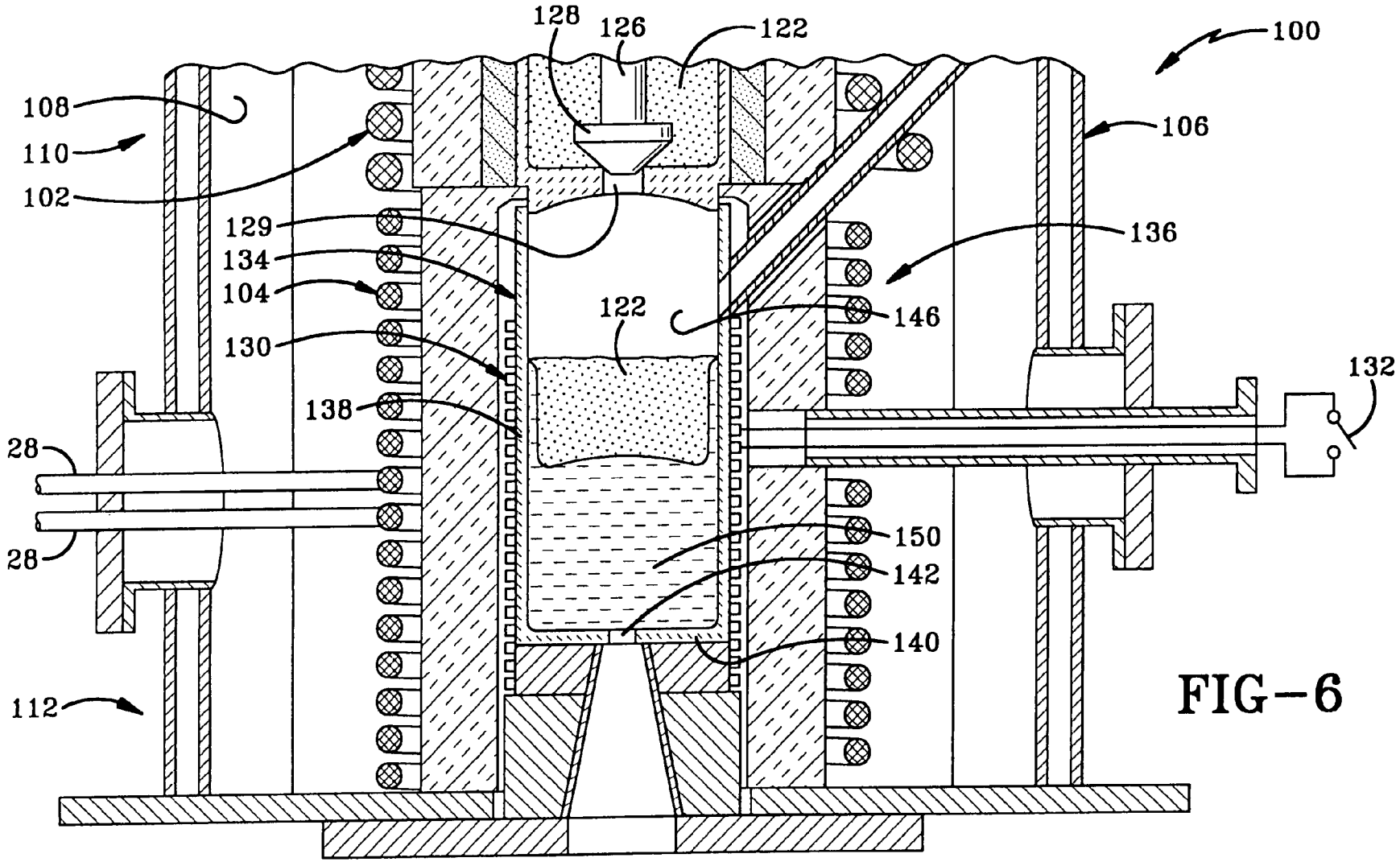
FIG. 6 is similar to FIG. 5 showing a further stage of melting.

In accordance with another feature of the invention and with reference to FIG. 5, power supply 26 provides electrical power to melting induction coil 104 which creates an electromagnetic field so that induction coil 104 couples with melting coil 130 to inductively heat melting coil 130. Inductive heating of melting coil 130 occurs when switch 132 is closed and melting coil 130 thereby forms a closed electrical circuit whereby melting coil 130 is thus initially operated in a closed electrical circuit mode. Once inductively heated, melting coil 130 transfers heat to raw material 122 in melting cavity 146 of crucible 134 predominantly through side wall 138 of crucible 134. As shown in FIG. 5, an initial portion of raw material 122 has melted, the molten portion indicated at 150. During this initial melting process, it has been found that having a portion 152 of melting coil 130 disposed above the charge of material 122 in melting cavity 146 (that is, the material 122 resting within crucible 134 as opposed to the material 122 in a state of falling from preheat tube 118) substantially increases the initial melting rate. This is due to the radiation heat within melting cavity 146 above the charge of material 122 coming from portion 152 of melting coil 130, which compensates for radiation heat loss from said charge of material 122, so that said charge is heated more quickly. Once a sufficient portion of material 122 has been melted by heat transferred from melting coil 130, molten portion 150 becomes susceptible to inductive heating by induction coil 104. Because melting coil 130 is heating through side wall 138, molten material 150 will include a cylindrical portion which flows down to form a pool portion. The cylindrical portion along side wall 138 provides a greater surface area of susceptible material in comparison to the pool portion, so that direct inductive heating of material 150 is enhanced thereby (FIGS. 5-6).

Another feature of the present invention is heating melting coil 130 resistively, either in combination with the inductive heating or as the sole source of heating melting coil 130. To do this, power supply 26 provides electrical power to melting coil 130 via wires 30 while melting coil 130 forms a closed electrical circuit. Whether used alone or in combination with inductive heating of melting coil 130, the heating of material 122 thereby is continued until a portion of material 122 becomes susceptible to inductive heating.

In accordance with another feature of the present invention, once portion 150 becomes susceptible to inductive heating, switch 132 is opened so that melting coil 130 is in an open electrical circuit mode whereby inductive heating of melting coil 130 by induction coil 104 is predominantly eliminated. More particularly, when melting coil 130 is in the open electrical circuit mode or forms an open electrical circuit, inductive heating of melting coil 130 by induction coil 104 which would occur if melting coil 130 were in the closed electrical circuit mode is eliminated. If melting coil 130 is heated solely by resistance or by resistance in combination with inductive heating by induction coil 104, opening the closed circuit of melting coil 130 also terminates resistive heating. Thus, with melting coil 130 being in an open electrical circuit mode, melting coil 130 has largely "disappeared" to induction coil 104, absorbing very little further energy from the electromagnetic field produced by induction coil 104, as discussed further below. Instead, induction coil 104 couples with the susceptible molten material 150 to directly inductively heat molten portion 150. This direct inductive heating of the susceptible material 150 permits heat to be transferred from molten portion 150 to solid raw material 122 to continue to melt material whereby the additional molten material also becomes susceptible to inductive heating. The "disappearance" of melting coil 130 to inductive heating decreases the heat imparted to crucible 134, which tends to extend the life of crucible 134.

FIG. 5 also shows the continued addition of raw material 122 after melting has begun. Furnace 100 is configured to add raw material 122 as desired. It is often desirable to continuously or intermittently add raw material 122 throughout the melting process to provide continuous or intermittent melting and transfer of molten material 150 out of crucible 134. However, raw material 122 may simply be added in a batch form and melted in its entirety without further additions.

Figure 7:
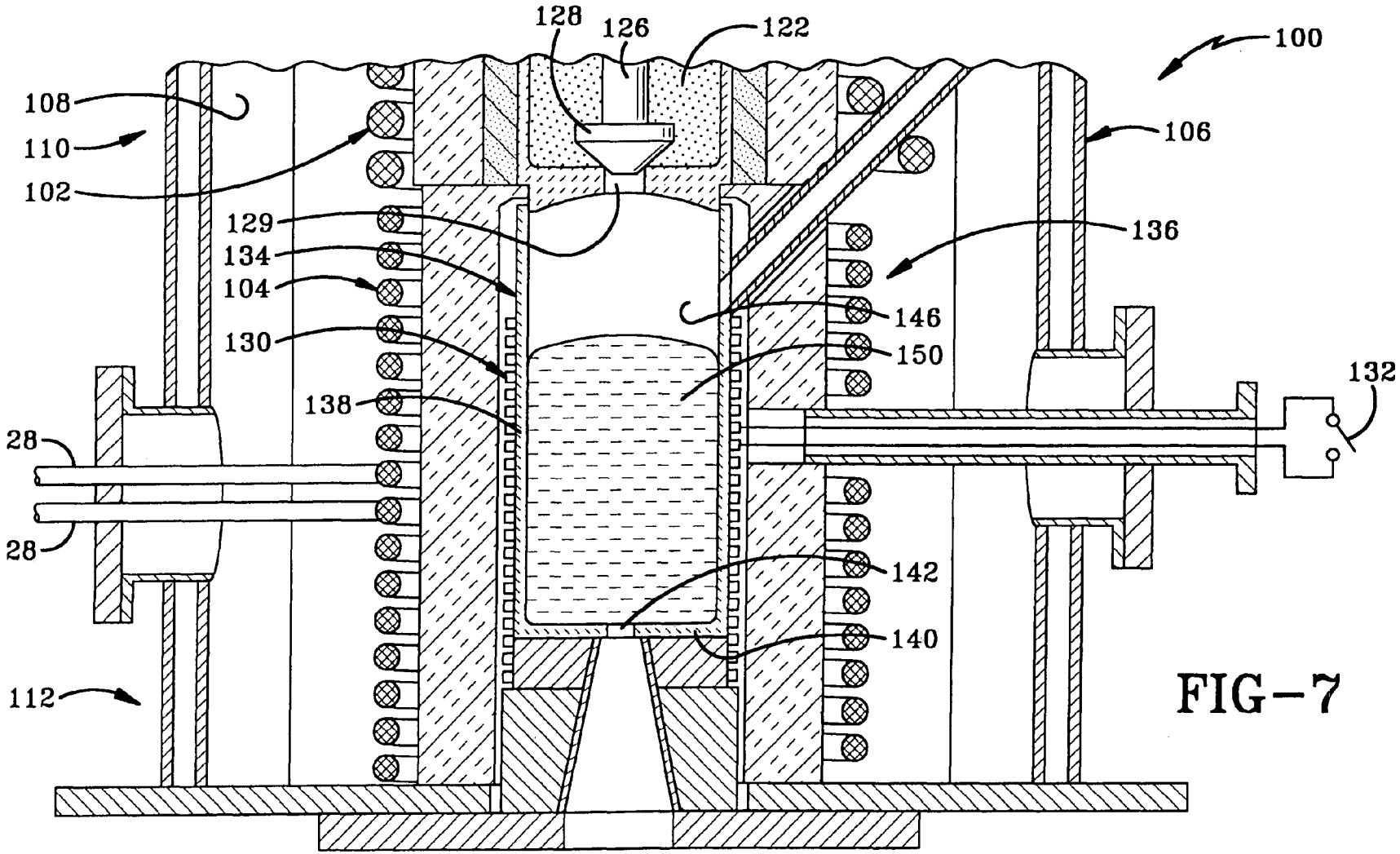
FIG. 7 is similar to FIG. 6 showing all the material within the crucible in a molten state.

FIG. 6 shows a further stage of melting with switch 132 in the open position whereby melting coil 130 has "disappeared" to coil 104, as noted above. Melting of raw material 122 proceeds via direct inductive heating of molten material 150 until all the material within melting cavity 146 is molten, as shown in FIG. 7. Switch 132 remains in the open position, as the inductive heating of melting coil 130 is not needed or desired after initial molten portion 150 becomes directly heatable by induction. Additional raw material 122 may then be added to the fully molten material, as shown in FIG. 2. Molten material may then be released through exit opening 142 to make room for additional raw material to enter melting cavity 146 so that furnace 100, as noted above, is capable of continuous or intermittent melting. As previously noted, when induction furnace 100 is used with semiconductor materials, molten semiconductor material may be transferred intermittently or continuously in to tundish 120 from which semiconductor materials may be processed or crystals may be pulled.

Another feature of the invention is quiescent zone 131 (FIG. 2), which is disposed below preheat assembly 114 and provides sufficient space to prevent obstruction of the flow of particulate material 122 from preheat assembly 114 to molten material 150 within melting cavity 146. Several problems may arise absent quiescent zone 131, three of which are specified: sticking, premature melting and wicking. Each of these problems relates to the distance between the lower end of preheat assembly 114 (as at exit opening 129 of preheat tube 118) and a source of heat there below. Typically, the source of this heat is molten material 150 within melting cavity 146 as heated by induction coil 104. The first two of these problems, sticking and premature melting, are due to overheating of material 122 just prior to exiting from preheat assembly 114 as a result of heat created within melting zone 112 and radiating within melting cavity 146 toward preheat assembly 114.

Sticking is when material 122 becomes sufficiently hot (at a sub-melting temperature) to cause particles of material 122 to stick to one another and to preheat assembly 114, thus obstructing the flow of material 122 from preheat assembly 114. Premature melting is essentially an advanced-stage of sticking, whereby material 122 melts prior to exiting preheat assembly 114. The resultant molten material then sticks to preheat assembly 114 and similarly obstructs the flow of material 122 therefrom whether the material remains molten or freezes on preheat assembly 114. Thus, sticking and premature melting both involve particles of material 122 sticking to preheat assembly 114. Premature melting makes correction of the problem more difficult due to molten material ultimately freezing and bonding with greater tenacity to preheat assembly 114 than in the case of "sticking", wherein the particles do not melt.

The third problem, wicking, relates primarily to the distance between preheat assembly 114 and an upper surface 154 of molten material 150 within melting cavity 146. Wicking is when a portion of molten material 150 within melting cavity 146 wicks upwardly within interstitial spaces between particles of material 122 via capillary action. When wicking occurs, sufficient heat from said portion of molten material 150 is absorbed by particulate material 122 so that said portion freezes and forms a bridge between molten material 150 in melting cavity 146 and preheat assembly 114, thus obstructing the flow of material 122 from preheat assembly 114. Quiescent zone 131 is of sufficient size to prevent obstruction of the flow of material 122 in regard to each of these three problems.

FIG. 8 shows the electromagnetic field produced by induction coil 104 and shows how the electromagnetic field focuses energy on susceptor 116 when switch 132 is closed. While FIG. 8 shows raw material falling into crucible 134, the same electromagnetic field pattern exists regardless of whether the crucible is filled or unfilled of raw material 122 prior to the time when material 122 becomes susceptible to inductive heating. By contrast, FIG. 9 shows the electromagnetic field after raw material 122 has melted to form molten material 150 and when switch 132 is open, whereby the electromagnetic field focuses energy on molten portion 150 of the material within crucible 134. Due to the "disappearing" nature of melting coil 130, the energy being absorbed by melting coil 130 in the closed circuit mode largely shifts to the susceptible molten material in crucible 134 when melting coil 130 is in the open circuit mode.

Thus, of the total energy being absorbed by melting coil 130 and the susceptible material within crucible 134, the vast majority of the energy is being absorbed by melting coil 130 in the closed circuit mode and the vast majority of the energy is being absorbed by the susceptible material when melting coil 130 is in the open circuit mode. Typically, the "vast majority" of the energy being absorbed by melting coil 130 in the closed circuit mode is easily 85 percent or more and often is 90 or 95 percent or more. Similarly, the "vast majority" of the energy being absorbed by the susceptible material when melting coil 130 is in the open circuit mode is easily 85 percent or more and often is 90 or 95 percent or more. Where the melting coil or susceptor is appropriately configured, said percentage of the energy being absorbed by the melting coil in the closed circuit mode may be 99 percent or more and said percentage of the energy being absorbed by the susceptible material when the melting coil is in the open circuit mode may be 99 percent or more.

As is known in the art and with continued reference to FIG. 9, electric current flowing through induction coil 104 creates electromotive forces as indicated by Arrows A, which cause molten material 150 to flow in the direction shown by Arrows B, which show a pattern of current flow known as "quadrature" flow. This current flow within the molten material causes the molten material to have a positive meniscus and creates flow along the surface which aids in drawing raw material 122 into the melt. This is particularly helpful with small-sized particles which otherwise tend to sit atop the molten material due to the surface tension thereof. However, the ability of the quadrature flow to draw raw material 122 into the melt still has limitations and feeding powdered or other particulate material 122 too rapidly into the melting cavity can result in a dome of unmelted material known as a "bridge" sitting atop the molten material. This can cause superheating of the molten bath, leading to excessive refractory wear and potentially to melting of the crucible. As Arrows B in FIG. 9 show, in the upper quadrants, the currents flow upward in the central region and downward in the outer region along side wall 138 of crucible 134. Currents in the lower quadrants generally flow downwardly in the central region and upwardly in the outer region adjacent side wall 138, and thus have a pattern which is essentially the opposite of the upper quadrants.

In summary, induction furnace 100 provides a highly efficient means, via the "disappearing" melting coil, of inductively heating semiconductor materials and other materials in particulate form which are not initially susceptible to inductive heating but which become susceptible to inductive heating at higher temperatures or upon melting.

Induction furnace 200 is now described with reference to FIGS. 10-11. Furnace 200 is similar to furnace 100 except that the melting crucible has a different configuration and furnace 200 includes a generally cone-shaped member 214 within the crucible and a trap passage 218, each of which are described further below. Cone-shaped member 214 alters the flow pattern of currents within molten material in the crucibles. Trap passage 218 serves to control the flow of molten material out of the crucible via pressure differentials on either side of molten material within passage 218.

Induction furnace 200 includes a crucible 202 having a substantially cylindrical side wall 204 extending upwardly from a bottom wall 206. Crucible 202 includes a melting cavity 203, which is in communication with a pressure control source 205 (FIG. 14) for adjusting atmospheric pressure within melting cavity 203. With reference to FIG. 11, bottom wall 206 includes a generally cone-shaped portion 208 tapering upwardly and inwardly from a substantially flat annular portion 210 to an exit opening 212 formed in cone-shaped portion 208 of bottom wall 206. Exit opening 212 is in communication with a transfer passage 213, which is in communication with a pressure control source 215 (FIG. 14) for adjusting atmospheric pressure within passage 213.

Figure 10:
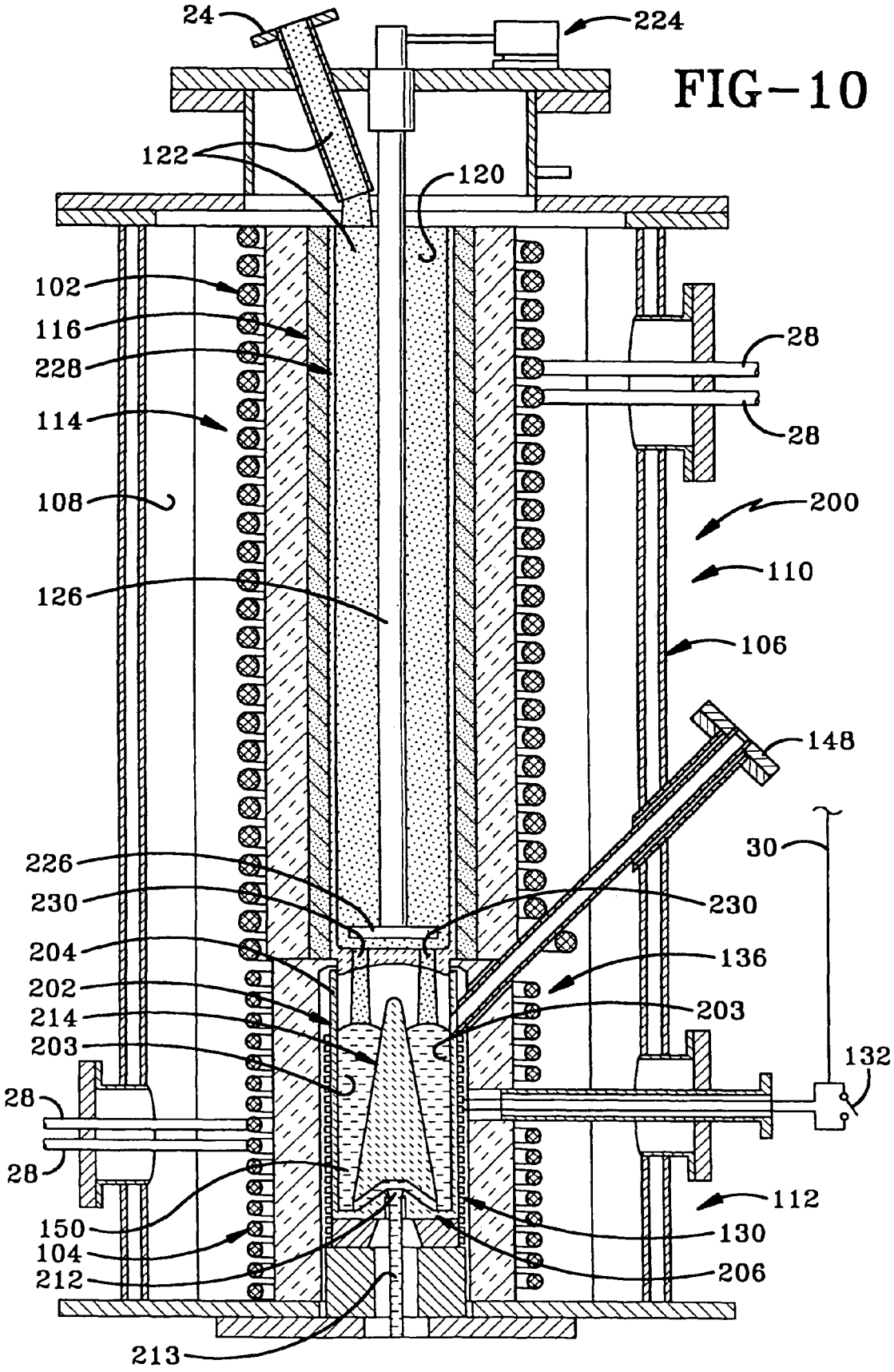
FIG. 10 is similar to FIG. 2 showing a second embodiment of the induction furnace of the present invention with a generally cone-shaped member within the melting cavity and a trap passage for controlling the flow of molten material from the crucible.
Figure 11:
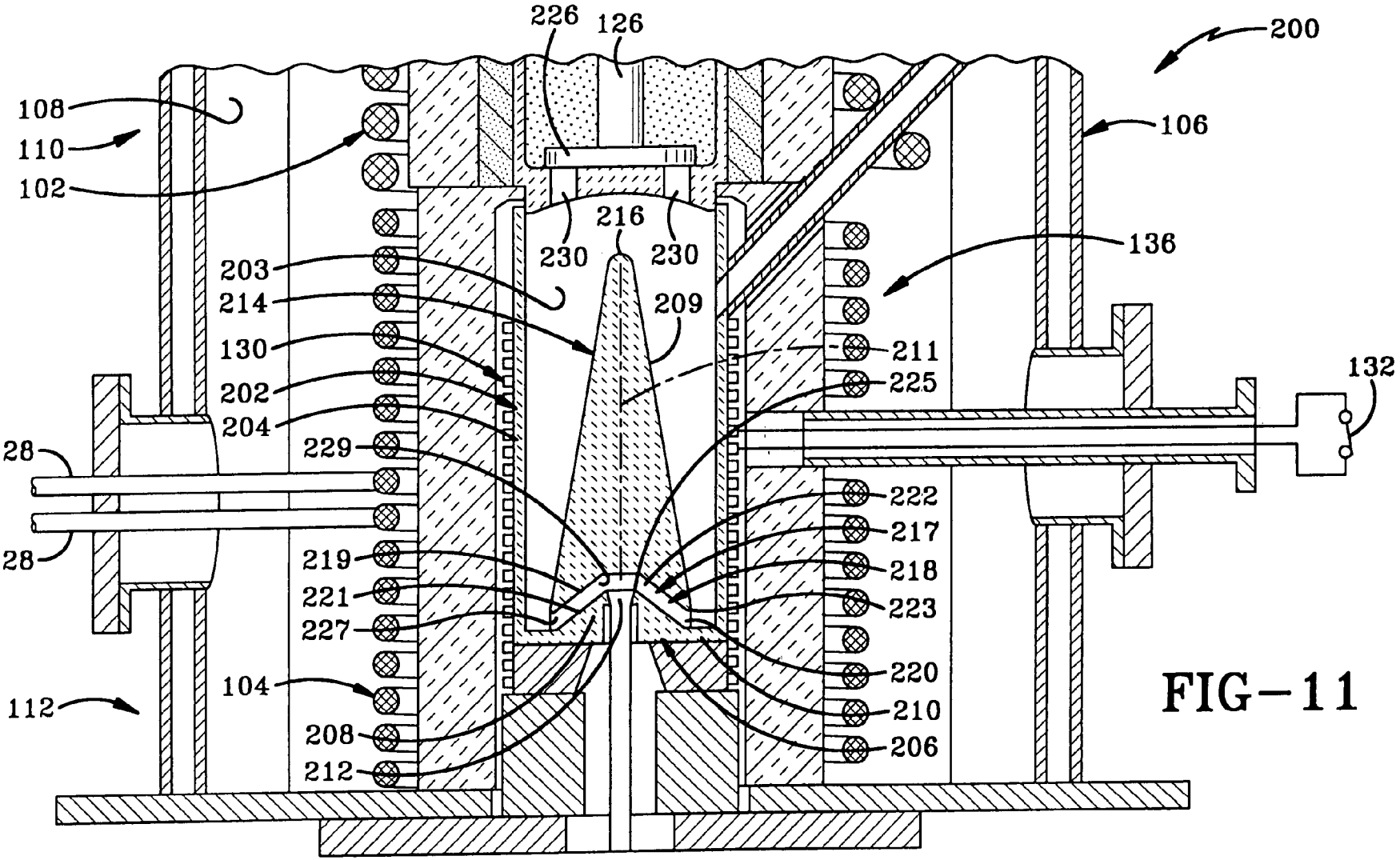
FIG. 11 is an enlarged fragmentary sectional view of the furnace shown in FIG. 10 wherein the crucible is empty.

In accordance with another of the main features of the invention and with continued reference to FIGS. 10-11, a flow guide in the form of substantially cone-shaped member 214 is seated within crucible 202 and mounted on bottom wall 206 thereof. Cone-shaped member 214 tapers upwardly and inwardly from adjacent bottom wall 206 and sidewall 204 to an apex 216 (FIG. 11) centrally located within the melting cavity of crucible 202. Cone-shaped member 214 has an outer surface 209 is radially symmetrical about a vertical central axis 211 (FIG. 11). Preferably, cone-shaped member 214 extends to a height above the level to which molten material will rise within melting cavity 203 of crucible 202.

Another feature of the invention (FIG. 11) is a trap 217 which defines a passage 218 formed generally above cone-shaped portion 208 of bottom wall 206 and generally below cone-shaped member 214. Trap passage 218 may be formed between bottom wall 206 and cone-shaped member 214 when member 214 is mounted thereon. Alternately, passage 218 may be formed within bottom wall 208 or within cone-shaped member 214. Trap passage 218 has a lower entrance end 220 defining an opening 227 in communication with melting cavity 203 of crucible 202 and an upper exit end 222 defining an opening 229 in communication with exit opening 212. Passage 218 has a crest 219 and a nadir 221, each extending along the length of passage 218. Crest 219 has a lowermost point 223 at lower entrance end 220. Nadir 221 includes several points, including point 225 at exit end 222, which are higher than lowermost point 223 of crest 219. Lowermost point 223 of crest 221 is at entrance end 220. More broadly, however, the lowermost point of the crest of a trap passage which will function as later described, may be anywhere along the trap passage as long as the nadir of the passage has a point which is higher than the crest lowermost point and which is situated between the crest lowermost point and the exit end of the passage.

However, such a trap passage describes only one category of trap passages. The passage may also, for example, be vertical in its entirety so that no crest or nadir extending along the length of the passage would exist. For such a vertical passage, the exit end opening would be higher than the entrance end opening, and more particularly, the lowermost point of the exit end opening of the passage would be higher than the uppermost point of the entrance end opening. There are further variations, such as certain passages having a portion with vertical walls and another portion which is inclined, which may not fall within either of the two categories noted. Such variations are within the scope of the present invention and can easily be discerned by one skilled in the art.

In addition, with reference to FIG. 10, furnace 200 includes a feed mechanism 224 similar to feed mechanism 124 except for a valve 226 which is distinct from valve 128. Valve 226 is a substantially flat disc shape member. Furnace 200 also includes a preheat tube 228 which is similar to tube 118 of furnace 100, except it finds a plurality of exit openings 230 situated in an annular fashion for aligning raw material 122 to generally fall between cone-shaped members 214 and side wall 204 of crucible 202.

As shown in FIGS. 10-15, furnace 200 functions as follows. Similar to furnace 100, raw material 122 in granular, powdered or other small-particle form, is fed through feed port 24 into the interior chamber of preheat tube 228 and is preheated as previously discussed. The flow of raw material 122 into melting cavity 203 of crucible 202 is controlled by feeding mechanism 224 whereby valve 226 moves in a vertical fashion between an open position to allow material to flow through exit openings 230 and a closed position to close openings 230 to prevent material from flowing.

Figure 12:
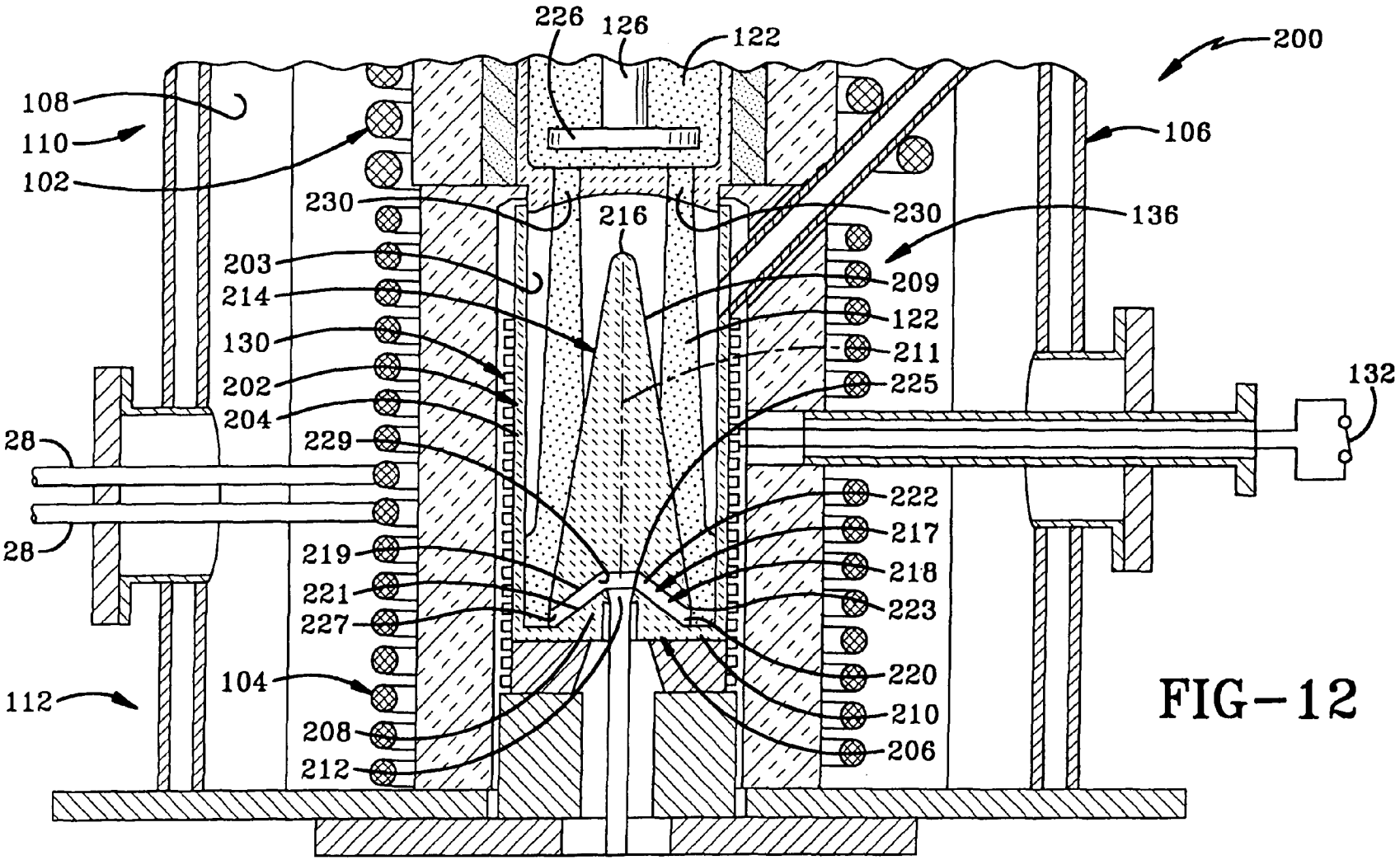
FIG. 12 is similar to FIG. 11 showing an initial charge of raw material entering the crucible.
Figure 13:
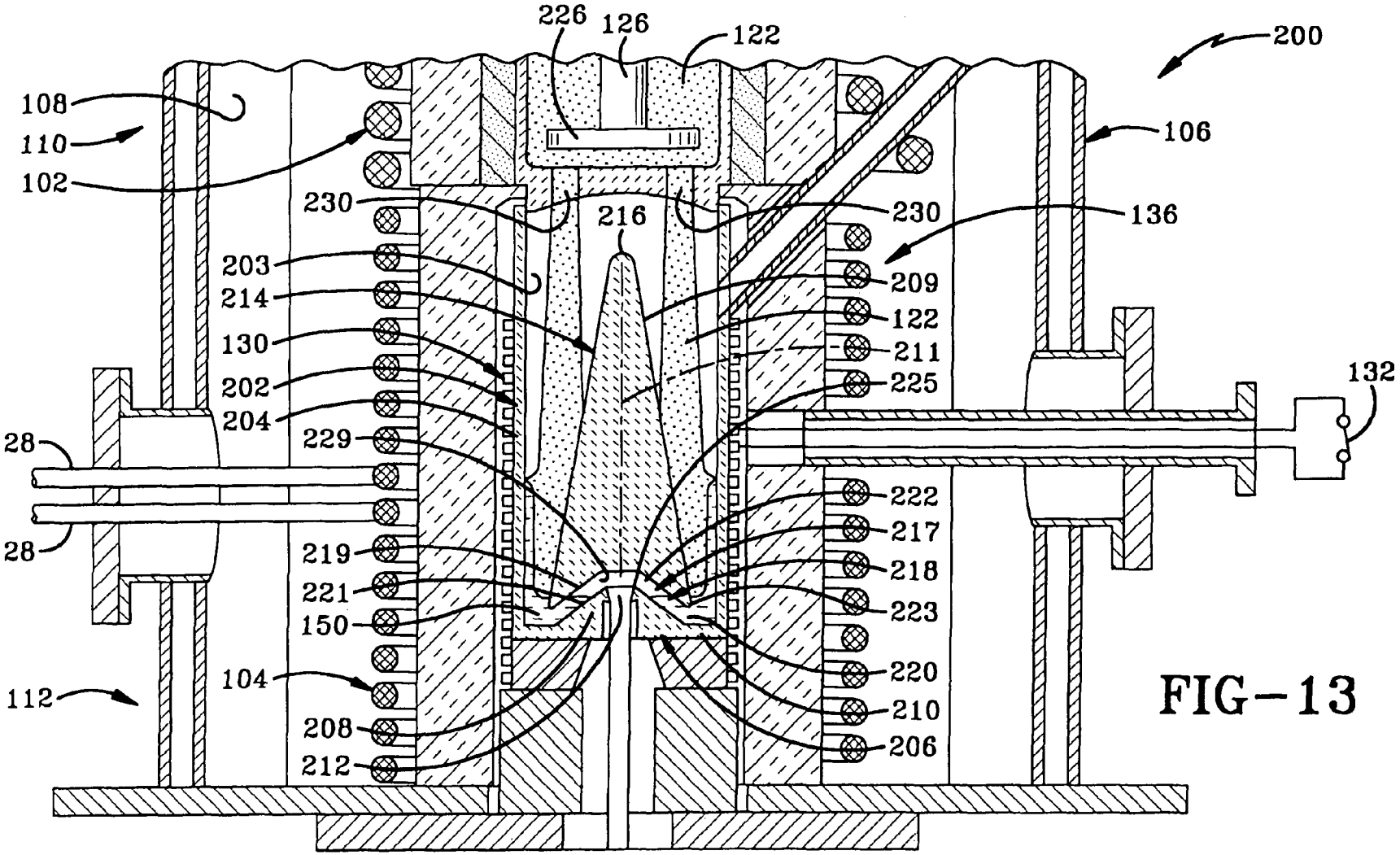
FIG. 13 is similar to FIG. 12 showing an initial molten portion of the raw material.

FIG. 11 shows valve 228 in the closed position to prevent raw material from flowing and crucible 202 prior to being charged with raw material 122. FIG. 12 shows valve 226 of feed mechanism 224 in a raised open position to allow raw material 122 to flow into melting cavity 203 of crucible 202 via exit openings 230. FIG. 13 shows raw material 122 continuing to flow through openings 230 and an initial stage of the melting process caused by electric power from power supply 26 flowing through induction coil 104 to inductively heat melting coil 130 in the closed circuit mode as previously described with regard to furnace 100. As previously described, molten portion 150 within melting cavity 203, has become susceptible to inductive heating by induction coil 104 so that melting coil 130 may be switched to the open circuit mode to prevent further inductive heating of melting coil 130 and to allow inductive heating of molten material 150. FIG. 13 shows some of molten material 150 within trap passage 218.

Figure 14:
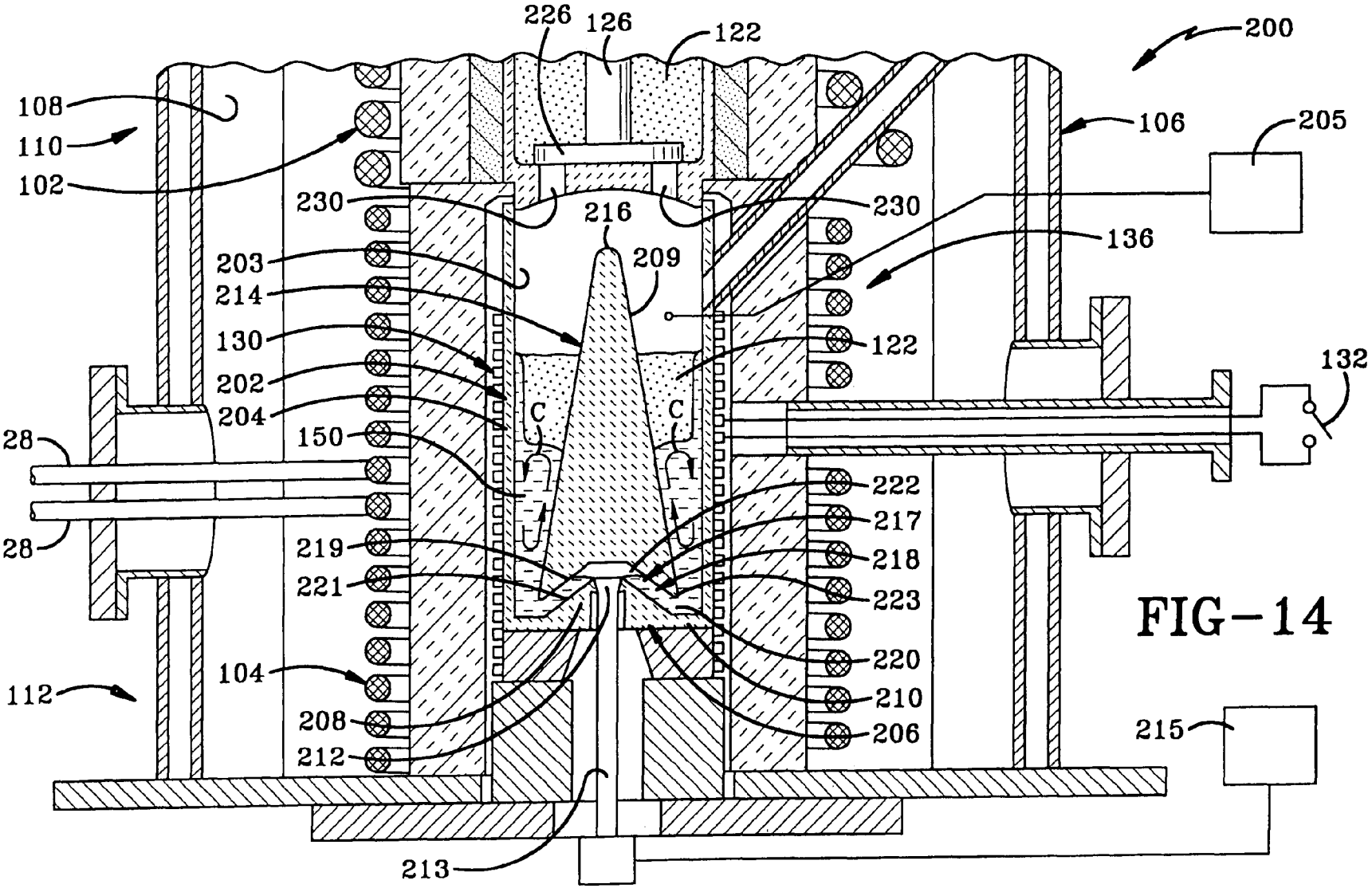
FIG. 14 is similar to FIG. 13 showing a further stage of the melting process.

In accordance with another feature of the invention and with reference to FIGS. 10, 13 and 14, trap 217 is configured so that the portion of molten material 150 in passage 218, forms a liquid seal between entrance end 220 and exit end 222, whereby a pressure differential on the molten material within passage 218 from respective ends 220 and 222 may be controlled to either prevent molten material 150 from flowing into transfer passage 213 (FIG. 14) or allow material 150 to flow out of melting cavity 203 and through exit opening 212 into transfer passage 213 (FIG. 10). When the pressure on the molten material in passage 218 from entrance end 220 is greater than the pressure on the molten material from exit end 222, molten material will flow out of melting cavity 203 through exit opening 212 (FIG. 10). Maintaining an equal pressure on said molten material from entrance end 220 and exit end 222 creates an equilibrium which prevents molten material from flowing out of melting cavity 203 and through exit opening 212 (FIG. 13-15).

One way of creating a pressure differential to make molten material flow from melting cavity 203 is to add sufficient material, molten and/or raw, to melting cavity 203 to overcome the pressure from exit end 222. As raw material 122 melts, a sufficient amount of molten material 150 will be produced so that it will naturally flow out through exit opening 212 absent other controls. Thus, controlling the pressure of the atmosphere exerted on molten material 150 in passage 218 from entrance end 220 and exit end 222 provides control of the flow of molten material 150. FIG. 14 shows pressure control sources 205 and 215 for controlling this atmospheric pressure. Source 205 may decrease atmospheric pressure from entrance end 220 and/or source 215 may increase atmospheric pressure from exit end 222 to counter the pressure from molten material 150 in melting cavity 203 in order to prevent the flow of molten material through exit opening 212. Alternately, source 205 may increase atmospheric pressure from entrance end 220 and/or source 215 may decrease atmospheric pressure from exit end 222 to allow molten material 150 to flow.

The height of the trap passage also controls flow of molten material 150 out of crucible 202. Increasing the height allows more molten material 150 to collect in the trap passage, and consequently in melting cavity 203, without the need to use a pressure differential to prevent flow through the exit opening. This basic concept is illustrated in FIG. 13 which shows that insufficient material 122 has been melted to raise the level of molten material 150 within passage 218 above exit opening 212.

Figure 15:
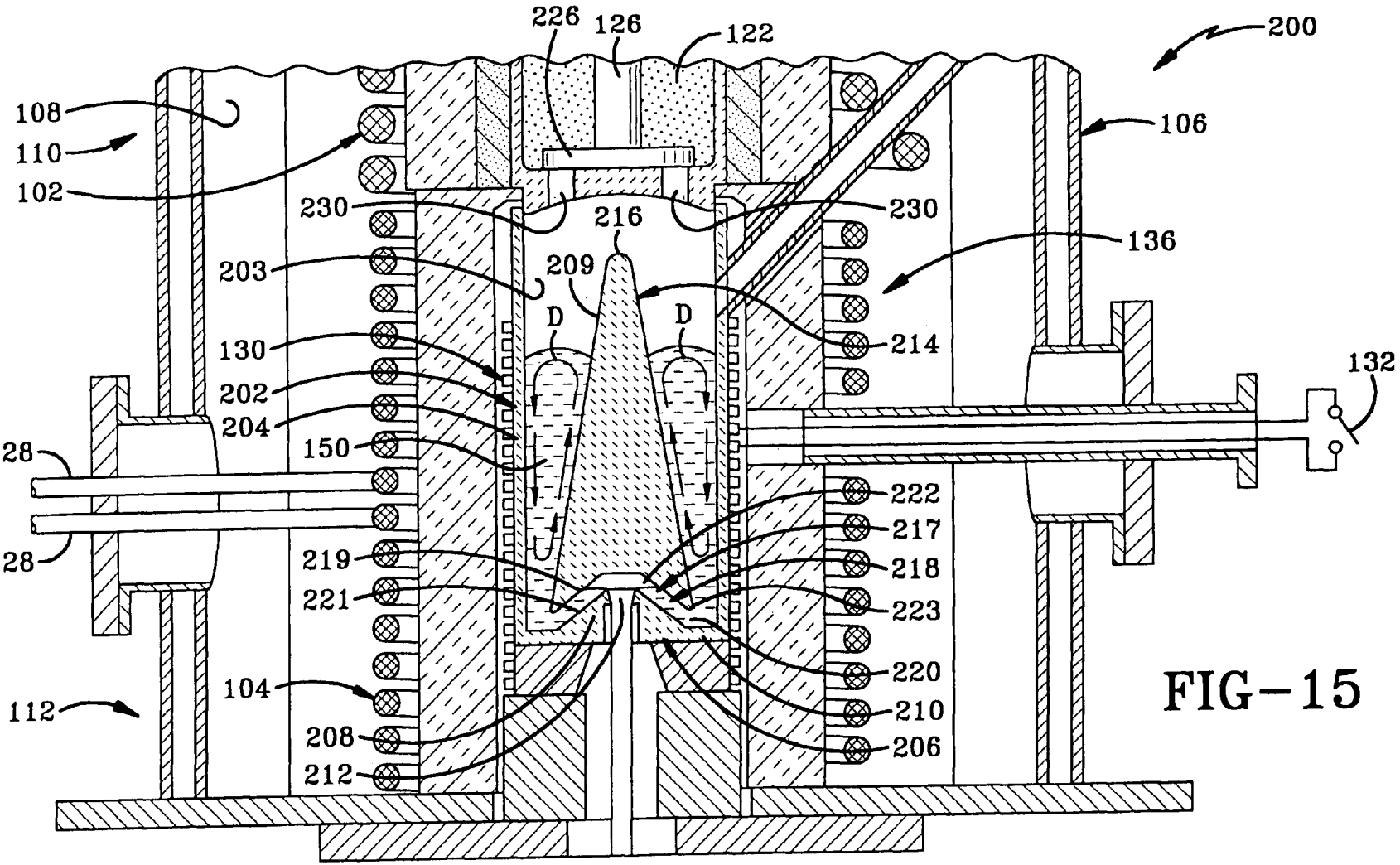
FIG. 15 is similar to FIG. 14 showing all material in the crucible is molten.

FIG. 14 shows an intermediate stage of melting and FIG. 15 shows all the material within crucible 202 in a molten state. In FIGS. 14 and 15, valve 226 is in a closed position to prevent further addition of raw material 122, and switch 132 is in the open position and molten material is being inductively heated directly by induction coil 104.

In accordance with one another feature of the invention, cone-shaped member 214 has altered the quadrature flow pattern discussed above with reference to FIG. 9 so that the molten material within melting cavity 203 flows as indicated by Arrows C in FIG. 14 and Arrows D in FIG. 15. In the quadrature pattern of FIG. 9, current flow in the lower quadrant flows downward in the central region of the melting cavity and upward in the outer region. However, in the present embodiment illustrated in FIGS. 14 and 15, as material is pushed inwardly due to the electromotive forces, the inward flow within the molten material which would have turned downwardly in the central region of the lower quadrants, is translated by the tapered shape of cone-shaped member 214 and forced upwardly instead. Thus, essentially all of the molten material along the outer surface of cone-shaped member 214 is forced in an upward direction and creates the pattern shown by Arrows C in FIG. 14 and Arrows D in FIG. 15. The flow is more of a single revolving loop pattern on each side of cone-shaped member 214 as opposed to the pair of loops revolving in opposite directions that occurs within the right or left half of the quadrature pattern of FIG. 9.

As a result of the molten metal flow created by cone-shaped member 214, the molten material moves more rapidly overall and creates a higher positive meniscus between cone-shaped member 214 and side wall 204 of crucible 202. Along with the greater velocity of molten material comes greater turbulence along the surface of the molten material. This increased velocity and turbulence creates an improved ability to draw the small-particle raw material 122 into the molten material to significantly enhance the melting process. As noted, this new current flow provides a higher meniscus and thus increases the surface area of the molten material to provide greater overall contact between the raw material and the molten material. Another benefit of this flow is the production of greater homogeneity of temperature within the molten material. This improved temperature uniformity within the melt translates to a more uniform temperature within the crucible, which is particularly helpful regarding the bottom wall, and thus increases the life of the crucible. Further, to the extent that there is a difference of temperature within the molten material, the hotter portion is at the top of the melt, which improves melting of the solid raw material and also prevents superheating at the bottom of the melt which could lead to melting the crucible.

Once all of the material is molten within melting cavity 203, it is a relatively simple matter to maintain a continuous or intermittent melting process by simply opening valve 226 to provide additional raw material 122 to melting cavity 203 and allowing molten material to flow through exit opening 212 to provide additional room for new molten material, as shown in FIG. 10.

The third embodiment of the present invention, induction furnace 300, is now described with reference to FIGS. 16-17. Furnace 300 is similar to furnace 100 except that furnace 300 includes a disc-shaped susceptor 302 positioned below crucible 134 closely adjacent bottom wall 140 thereof. Preferably, susceptor 302 abuts bottom wall 140. Susceptor 302 has a substantially cylindrical outer perimeter 304 and an inner perimeter 306 defining a central hole 308. Susceptor 302, typically a graphite disc, is not a significant expense.

Another feature of the invention is that outer perimeter 304 of susceptor 302 is further away from induction coil 104 than is an inner surface 312 of crucible side wall 138. More particularly, susceptor 302 and crucible 134 are configured so that a space 310 within melting cavity 146 is closer to induction coil 104 than is susceptor 302 so that a portion of molten material 150 within space 310 may be closer to coil 104 than is susceptor 302. Space 310 lies between inner surface 312 of side wall 138 and an imaginary cylinder defined by lines E extending upwardly from outer perimeter 304 of susceptor 302. Thus, space 310 is disposed within melting cavity 146 all the way around the cylinder defined by lines E and adjacent sidewall 138 along bottom wall 140.

Figure 18:
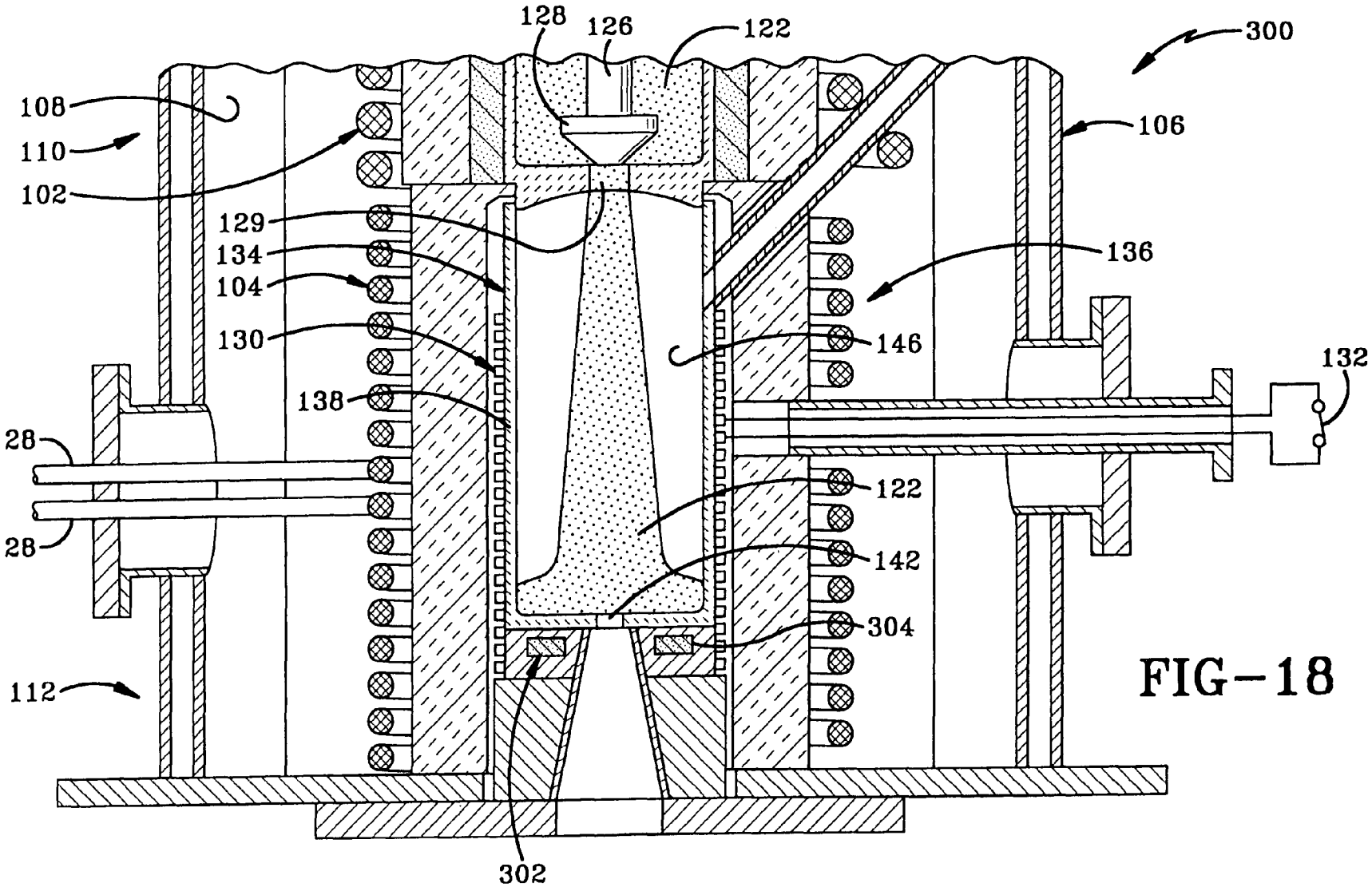
FIG. 18 is similar to FIG. 17 showing an initial charge of raw material in the crucible.
Figure 19:
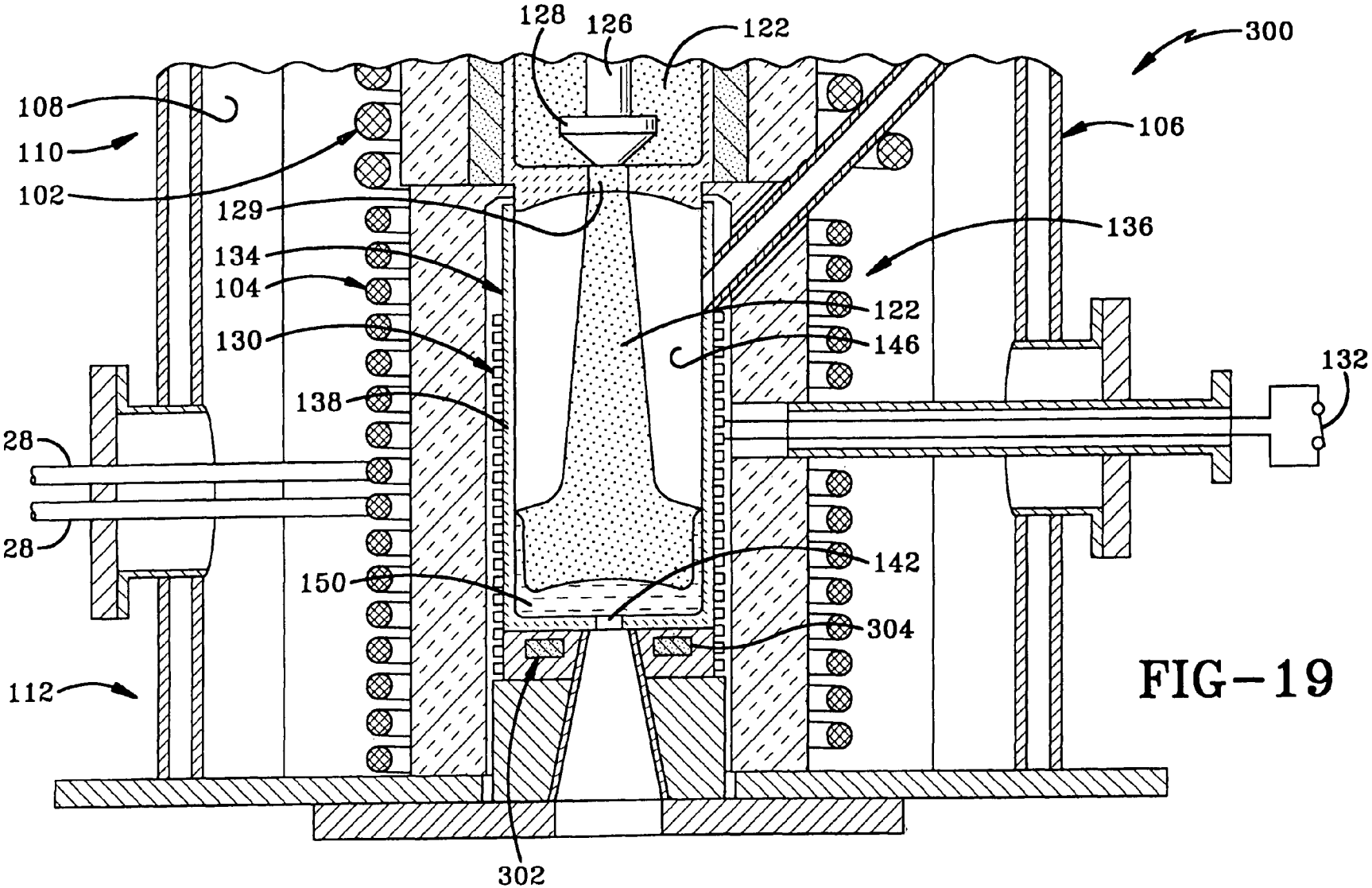
FIG. 19 is similar to FIG. 18 showing an initial molten portion of the raw material.

With reference to FIGS. 17-21, furnace 300 operates as follows. FIG. 17 shows crucible 134 prior to being charged with raw material 122. FIG. 18 shows crucible 134 being charged with raw material 122. At this point or sometime before or shortly afterward, electrical power from power supply 26 produces an electrical current through induction coil 104 and switch 132 is in the closed position whereby susceptor or switchable coil 130 is inductively heated by the electromagnetic field produced by coil 104 as previously described. Once electrical current is flowing through induction coil 104, it also couples electromagnetically with susceptor 302 to inductively heat susceptor 302 which in turn transfers heat to raw material 122 in order to facilitate melting a portion of material 122. Thus, melting coil 130 and susceptor 302 are used in conjunction to melt the initial portion 150 of raw material 22, as shown in FIG. 19, so that molten portion 150 may then be inductively heated directly by induction coil 104.

Once portion 150 has become inductively heatable, switch 132 is opened as discussed above, whereby inductive heating of melting coil 130 ceases. Susceptor 302 remains in place and continues to be inductively heated decreasingly as molten material 150 is increasingly inductively heated. Due to the configuration of susceptor 302 described above, the portion of molten material 150 within space 310 is closer to induction coil 104 than is susceptor 302 whereby inductive heating naturally tends towards the molten material because it is closer to induction coil 104. During the melting process, energy absorbed by molten material 150 from the electromagnetic field produced via induction coil 104 increases and energy absorbed by susceptor 302 from the electromagnetic field decreases. Of the combined energy being absorbed by molten material 150 and susceptor 302, at a certain time, nearly all of the combined energy is being absorbed by molten material 150 and very little is being absorbed by susceptor 302. This usually occurs when all the material is fully molten or nearly so in melting cavity 146. Thus, the configuration of susceptor 302 permits it to nearly "disappear" to the inductive heating effect from induction coil 104.

Figure 20:
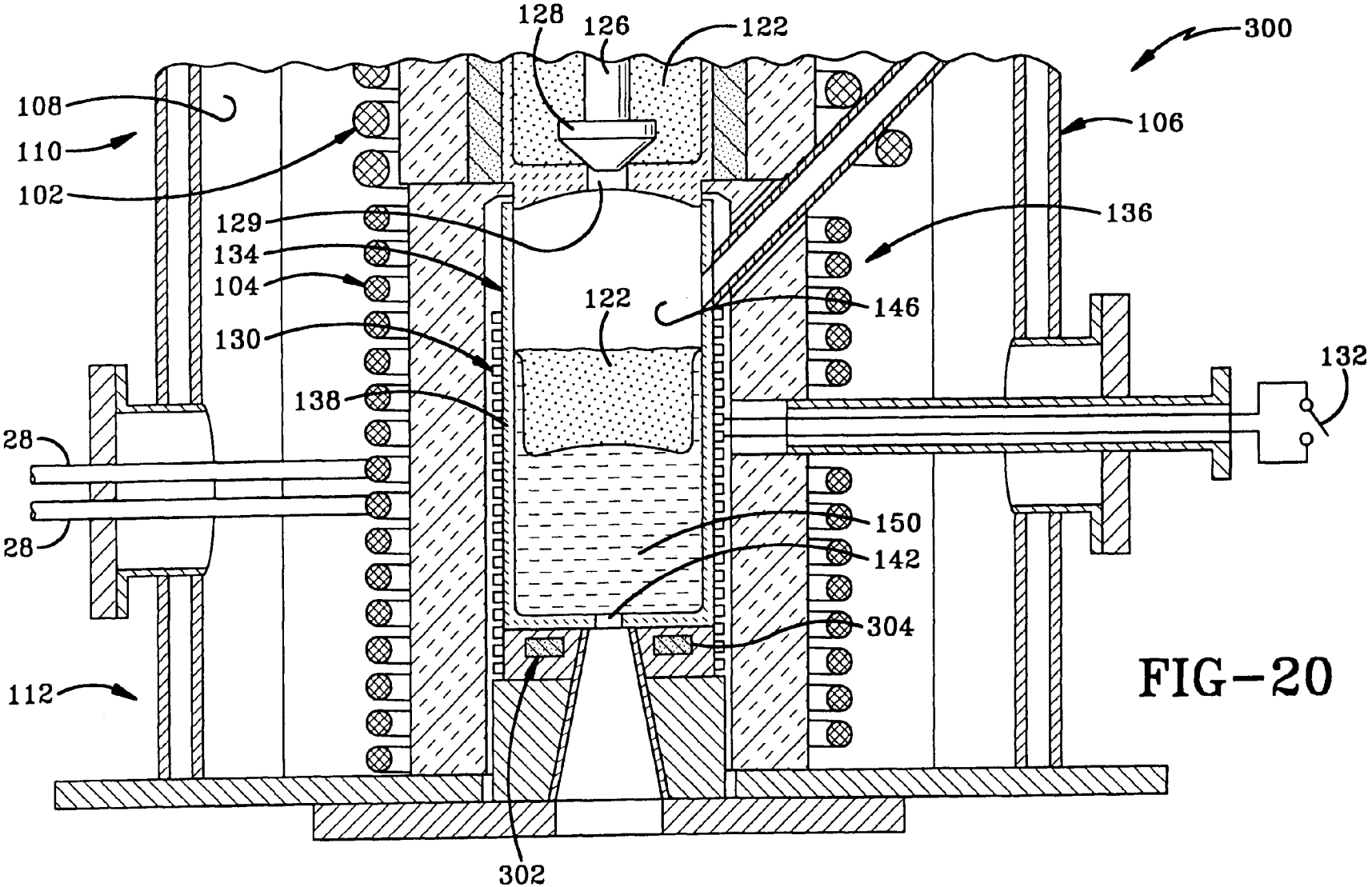
FIG. 20 is similar to FIG. 19 showing a further stage of melting.
Figure 21:
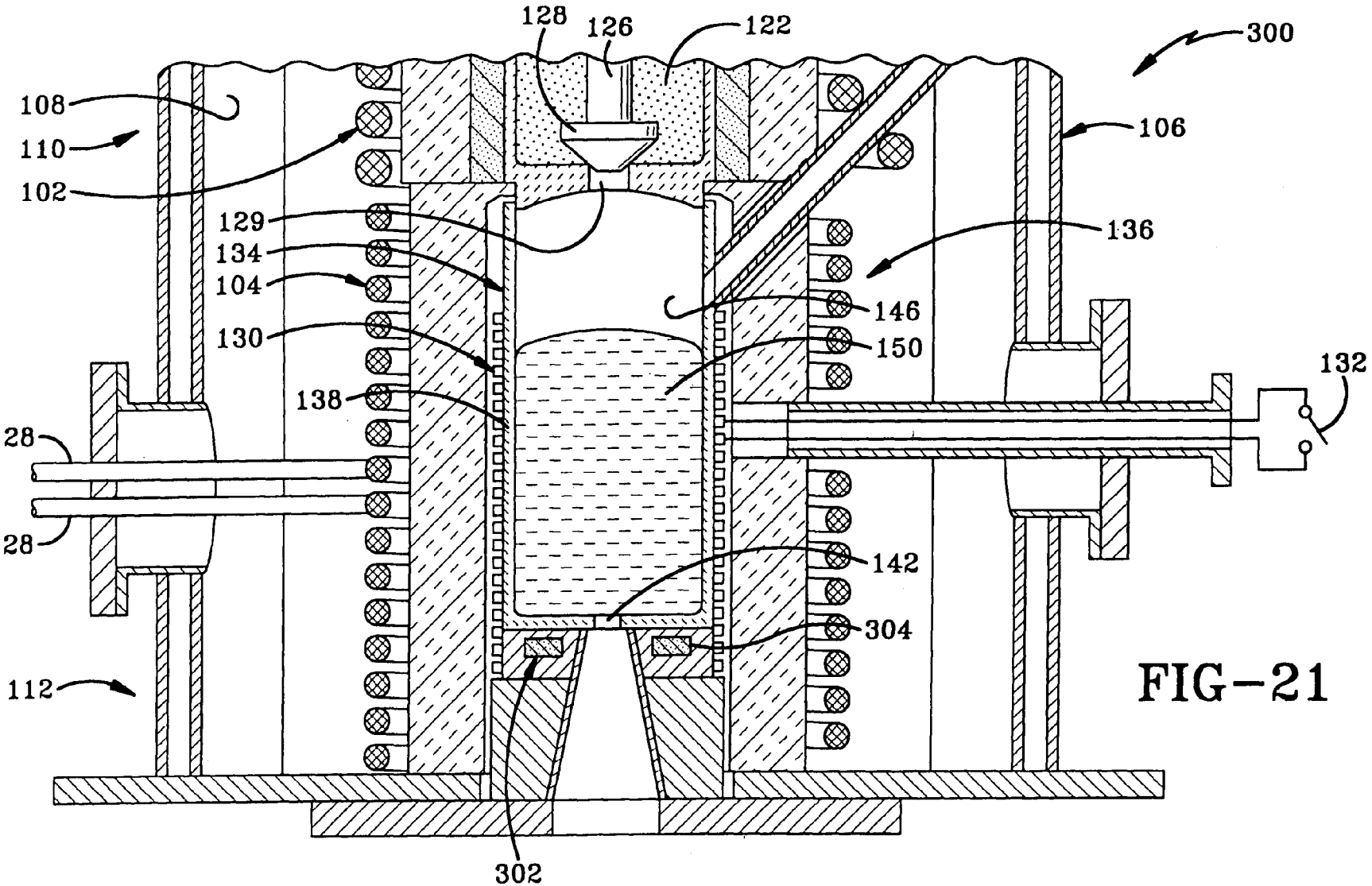
FIG. 21 is similar to FIG. 20 showing all of the material in the crucible in a molten state.

FIG. 20 shows an intermediate stage of melting wherein a portion of raw material 122 is molten and a portion is still in solid form. Switch 132 is in the open position so that melting coil 130 is no longer being inductively heated. Susceptor 302 at this point is still being inductively heated to some degree although this is decreasing as previously noted. By the time all the material within crucible 134 is molten, as shown in FIG. 21, essentially all the inductive heating taking place is occurring directly within molten material 150 while a relatively small amount is occurring within susceptor 302. Hole 308 in susceptor 302 allows for a central pouring mechanism so that molten material may flow through hole 308. Additional material 122 may be added via exit opening 129 and molten material may be removed through exit opening 142, as shown in FIG. 16, so that furnace 300 is capable of continuous and intermittent melting.

The fourth embodiment of the present invention, induction furnace 400, is now described with reference to FIG. 22. Furnace 400 is similar to furnace 100 except that furnace 400 includes a melting coil 430, which acts as a susceptor and is disposed within melting cavity 146 of crucible 134 instead of outside crucible 134. Because melting coil 430 is situated centrally within melting cavity 146, a feed mechanism like feed mechanism 224 used with the furnace 200 is utilized. The location of melting coil 430 within crucible 134 may vary, however, and thus other feed mechanisms may be more suitable depending on said location and the specific configuration of such an internal susceptor. Melting coil 430 is encased within a refractory material 432 such as ceramic, although this may vary in accordance with the material to be melted or heated. The basic concept of melting coil 430 is the same as that of melting coil 130 other than its location. More specifically, melting coil 430 may be switched between an open circuit mode and a closed circuit mode via switch 132 and is thus heatable as described with respect to furnace 100. The melting pattern which occurs with the use of melting coil 430 differs in that material 122 begins to melt adjacent melting coil 430 instead of adjacent sidewall 138. In addition, once material 122 becomes susceptible to inductive heating, induction coil 104 will tend to couple with material 122 in preference to coupling with melting coil 430 even when the circuit is closed because some susceptible material is closer to induction coil 104 than is melting coil 430, as explained with regard to susceptor 302 of furnace 300. Opening the circuit of melting coil 430, however, further removes melting coil 430 from being inductively heated, as with the other "disappearing" coils.

Thus, induction furnaces 100, 200, 300 and 400 provide novel configurations and methods of inductively heating and melting particulate material which is initially not inductively heatable and which becomes inductively heatable when heated to a certain temperature and especially upon melting. It will be appreciated that a great number of changes may be made to each of these furnaces without departing from the spirit of the invention. It will be appreciated that each of these furnaces may function without the preheating assembly although this facilitates the melting process. In addition, the preheating assembly may be of other suitable configurations which do not use inductive heating.

Furnaces 100, 200, 300 and 400 utilize the "disappearing" melting coil 130 or 430 particularly for melting such materials as described herein. However, the concept of the disappearing coil may be utilized in a wide variety of circumstances. It need not be used for melting purposes, but may be used simply to inductively heat something in a selective fashion whereby the switch may be turned on and off as desired. In addition, melting coil 130 or 430 need not be in a coil form but merely needs to form a closed circuit when a switch is closed and an open circuit when the switch is open whereby it can be inductively heated when the switch is closed. Further, melting coil 130 or 430 need not be disposed within an induction coil which is in the form of a cylinder or other shape. Instead, melting coil 130 or 430 may be positioned externally near an induction coil so that it is within the electromagnetic field produced thereby. At a broader level, the electromagnetic field which inductively heats melting coil 130 or 430 need not be produced by an induction coil but by any induction member through which an electrical current may be passed to create an electromagnetic field capable of inductively heating melting coil 130 or 430 or a similar disappearing coil. For the purposes of an induction furnace for melting highly refractory materials, the exemplary embodiments are preferred due to their levels of efficiency.

Further, the use of the disappearing coil is not limited to melting or heating only particulate material. It may also be used to melt or heat larger pieces of material. Thus, for example, the disappearing coil may be effectively used with larger pieces of materials which, like semi-conductor materials, are not inductively heatable in solid form regardless of size. In addition, the present invention may also be used with fibrous materials or other materials having geometries which are particularly difficult to melt via inductive heating.

Certain liquids are also particularly suited to heating with the present invention, for example, those liquids which are not susceptible to inductive heating at a relatively lower temperature but which are susceptible to inductive heating at relatively higher temperature. The invention is also suitable for heating liquids which are susceptible to inductive heating at relatively higher frequencies (i.e., higher frequency electrical current to the induction coil) at a relatively lower temperature and which are susceptible to inductive heating at relatively lower frequencies at a relatively higher temperature due to the corresponding lowered resistivity of the liquid at the higher temperature. This may include scenarios wherein such liquids are simply not inductively heatable at the relatively lower frequency when the liquid is at the relatively lower temperature. This may also include scenarios wherein such liquids are susceptible to inductive heating to some degree at the lower frequency and lower temperature, but only at a relatively lower efficiency, while this efficiency increases at the lower frequency when the temperature of the liquid is sufficiently raised. Thus, the invention is particularly useful in that the disappearing coil can heat such liquids to bring them into a temperature range where commercially feasible lower frequencies can be used to inductively heat the liquids, substantially increasing the efficiency of heating such liquids.

The flow guide, embodied as a cone-shaped member in induction furnace 200, may also take a variety of shapes, although a general cone shape is preferred, particularly with a cylindrical crucible and cylindrical induction coil. Other shapes which alter the flow of the molten material so that currents in the central or interior regions of a crucible melting cavity tend to flow upwardly rather than downwardly are within the scope of the concept of the present invention. As noted previously, such a change in the current flow within the molten material prevents overheating of the crucible bottom wall, provides greater uniformity of temperature within the melt and adds to the ability to draw raw material into the melt. Some of the obvious alternatives include a cone shape that has a convex or a concave outer surface. Also pyramidal shapes may be used or cone shapes that may have ridges and recesses such as a star-shaped cone-like structure. Other possibilities include a tent-shaped member having elongated sides which taper upwardly and inwardly or an elongated mound shape having a parabolic or semicircular cross section. In addition, while the outer surface of the member in issue is preferably continuous, it may also be noncontinuous and may be created by a plurality of members in combination. A host of other configurations is within the scope of the present invention.

With regard to the trap passage of induction furnace 200, many configurations are also possible, as previously described. With regard to the forming use of the cone-shaped member, a trap passage may be created by, for example, forming slots or other openings in the lower portion of the cone-shaped member. Further, such passages do not require the use of a cone-shaped member or the like. Consequently, the crucible bottom wall need not be generally cone-shaped, but may, for example, be substantially flat with a tube extending upwardly into the melting cavity to provide a raised exit opening in communication with an upper portion of the trap passage. The trap passage may also be disposed outside of the crucible, such as may be defined by a pipe extending outwardly from the crucible side wall.

Also with regard to induction furnace 200, the valve used in the preheating assembly may be used without a preheating assembly and may be of a variety of configurations. While it is preferable to guide the raw material directly onto the upper surface of the molten material, the raw material may also fall on to the cone-shaped member and so forth.

With respect to induction furnace 300, susceptor 302 need not be disc-shaped or have a hole formed therein. Susceptor 302 may have a variety of shapes as long as some space within the crucible melting cavity for holding a molten portion is closer to the induction coil than is the susceptor itself, whereby the susceptible molten material is preferentially inductively heated with respect to a susceptor analogous to susceptor 302. While susceptor 302 is typically made of graphite, it may be formed of any material capable of being inductively heated.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of heating material comprising the steps of:

passing an electric current through an electrically conductive member when the conductive member is in a closed electrical circuit mode to heat the conductive member resistively;

transferring heat from the resistively heated conductive member to the material during the step of passing;

switching the conductive member from the closed circuit mode to an open circuit mode after the step of passing;

heating the material inductively with an electromagnetic induction member while the conductive member is in the open circuit mode after the steps of passing, transferring and switching;

melting the material within a melting cavity of a crucible;

heating molten material inductively within the melting cavity to create flow of molten material due to electromotive forces emanating from the induction member; and guiding molten material flow upwardly within the melting cavity with a flow guide disposed therein in order to increase flow velocity of the molten material within the melting cavity to provide greater turbulence along an upper surface of the molten material relative to corresponding flow velocity and turbulence which occurs without use of the flow guide.

2. The method of claim 1 wherein the step of passing comprises the step of heating an electrically conductive member a portion of which is disposed within an interior space of the induction member.

3. The method of claim 2 wherein the step of passing comprises the step of passing the electric current through an electrically conductive coil which encloses a first area; and the step of heating comprises the step of heating the material inductively with an induction coil enclosing a second area that comprises the first area.

4. The method of claim 1 wherein the material is not susceptible to inductive heating before the step of transferring; the step of transferring comprises the step of transferring sufficient heat from the resistively heated conductive member to the material to make a portion of the material susceptible to inductive heating; and wherein the step of heating the material inductively comprises the step of heating the susceptible portion inductively with the induction member.

5. The method of claim 4 wherein the step of transferring sufficient heat from the resistively heated conductive member to the material to make a portion of the material susceptible to inductive heating comprises the step of melting the portion.

6. The method of claim 5 wherein the material is made up of particles having particle sizes sufficiently small so that the particles are not susceptible to inductive heating before the step of transferring; and the step of transferring comprises the step of transferring sufficient heat from the resistively heated conductive member to the particles to melt a portion of the particles to form a molten portion which is susceptible to inductive heating.

7. The method of claim 5 wherein the crucible is an electrically non-conductive crucible; further comprising the step of placing an initial charge of the material in the melting cavity in contact with a bottom wall of the crucible which defines a lowermost portion of the melting cavity;

wherein the step of melting comprises the step of melting an initial portion of the initial charge such that the initial portion is a molten portion which has become susceptible to inductive heating and which is in contact with the bottom wall of the crucible; and the step of heating the material inductively comprises the step of heating the molten portion inductively with the induction member while the molten portion is in contact with the bottom wall.

8. The method of claim 4 wherein the crucible is an electrically non-conductive crucible; further comprising the step of placing the material in the melting cavity; and wherein the step of heating the susceptible portion comprises the step of heating the susceptible portion inductively with the induction member to melt solid portions of the material.

9. The method of claim 1 further comprising the steps of preheating solid particles of the material in a preheat assembly; allowing the preheated solid particles of the material to fall through a quiescent zone to prevent obstruction of the flow of the material from the preheat assembly due to overheating and consequent sticking of the particles to the preheat assembly or due to formation of a bridge between molten material in the melting cavity and the preheat assembly via wicking of the molten material.

10. The method of claim 1 further comprising the step of controlling a relative pressure exerted on liquid material in a trap passage from an entrance end of the trap passage in communication with the melting cavity and from an exit end of the trap passage in communication with an exit opening formed in the crucible to selectively allow and prevent the flow of liquid material from the crucible cavity through the exit opening.

11. The method of claim 1 further comprising the steps of placing the material in the melting cavity, wherein the melting cavity is in an electrically non-conductive crucible; positioning an electrically conductive susceptor adjacent the crucible so that a portion of the melting cavity is closer to the induction member than is the susceptor; heating the susceptor inductively with the induction member; and transferring heat from the susceptor to the material in the melting cavity.

12. The method of claim 1 further comprising the step of heating the conductive member inductively with the induction member when the conductive member forms the closed electrical circuit mode.

13. The method of claim 1 wherein the material is electrically non-conductive before the step of transferring.

14. The method of claim 1 wherein the flow of molten material comprises flow along an upper surface of the molten material; and further comprising the step of feeding particulate material atop the upper surface of the inductively heated molten material whereby the flow along the upper surface aids in drawing the particulate material into the molten material.

15. An apparatus for heating a material, the apparatus comprising:

an electromagnetic induction coil having an interior space and adapted to inductively heat the material;

an electrically conductive member comprising an electrical circuit selectively switchable between a closed electrical circuit mode and an open electrical circuit mode;

wherein a portion of the conductive member is disposed within the induction coil interior space;

the conductive member is resistively heatable via the electrical circuit in the closed electrical circuit mode;

the induction coil is capable of being electrically powered when the conductive member is in the closed circuit mode and when the conductive member is in the open circuit mode;

the conductive member is adapted to transfer heat to the material; and a crucible defining a melting cavity adapted to contain molten material;

wherein the induction coil is configured to inductively heat molten material within the melting cavity; and further comprising:

a flow guide disposed within the melting cavity for directing the inductively heated molten material to flow upwardly within the cavity.

16. The apparatus of claim 15 wherein the crucible is an electrically non-conductive crucible; and wherein the conductive member comprises a coil defining an interior space in which a portion of the crucible is disposed.

17. The apparatus of claim 15 wherein the crucible is an electrically non-conductive crucible; and further comprising:

an electrically-conductive susceptor disposed adjacent the crucible;

wherein the induction coil is capable of inductively heating material within the melting cavity and the susceptor; and a portion of the melting cavity is closer to the induction member than is the susceptor.

18. The apparatus of claim 17 wherein the crucible comprises a bottom wall and a sidewall which extends upwardly from the bottom wall has an innermost surface; and the susceptor is located entirely below the bottom wall and entirely inwardly of the innermost surface.

19. The apparatus of claim 15 wherein the conductive member is inductively heatable by the induction coil via the electrical circuit in the closed electrical circuit mode.

20. The apparatus of claim 15 further comprising:

a preheat assembly for heating the material in solid particulate form prior to entering the melting cavity;

a quiescent zone which extends downwardly from the preheat assembly and through which the heated solid particulate material falls when feeding the melting cavity;

wherein the quiescent zone is suitably sized to prevent obstruction of the flow of the solid particulate material from the preheat assembly due to overheating and consequent sticking of the material to the preheat assembly or due to formation of a bridge between molten material in the melting cavity and the preheat assembly via wicking of the molten material.

21. The apparatus of claim 15 wherein the crucible has an exit opening; and further comprising:

a trap defining a through passage having an entrance end defining an opening in communication with the cavity and an exit end defining an opening in communication with the exit opening of the crucible; the trap passage adapted for transporting liquid material from the cavity to the exit opening of the crucible; and at least one of a pressure control source for controlling atmospheric pressure exerted on the liquid material from the entrance end of the passage and a pressure control source for controlling atmospheric pressure exerted on the liquid material from the exit end of the passage whereby the apparatus is adapted to control the flow of liquid material through the exit opening via a relative pressure exerted on liquid material in the passage.

22. The apparatus of claim 15 wherein the flow guide tapers upwardly and inwardly.

23. The apparatus of claim 22 wherein the flow guide has an outer surface which is substantially radially symmetrical with respect to a vertical axis.

24. The apparatus of claim 15 wherein the flow guide comprises a generally cone-shaped member which tapers upwardly and inwardly within the melting cavity.

25. The apparatus of claim 15 wherein the electrically conductive member is inside the crucible.

26. The apparatus of claim 15 wherein the electrically conductive member is in the form of a coil which is disposed within the induction coil interior space.

* * * * *